US011624262B2

(12) United States Patent
Steele et al.

(10) Patent No.: US 11,624,262 B2
(45) Date of Patent: Apr. 11, 2023

(54) MULTILATERAL JUNCTION WITH TWISTED MAINBORE AND LATERAL BORE LEGS

(71) Applicant: Halliburton Energy Services, Inc., Houston, TX (US)

(72) Inventors: David Joe Steele, Carrollton, TX (US); Srinivasa Prasanna Vemuri, Frisco, TX (US); Stacey Blaine Donovan, Fort Worth, TX (US); Morten Falnes, Sola (NO); Wesley Paul Dietz, Carrollton, TX (US); Christian Alexander Ramirez, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/118,182

(22) Filed: Dec. 10, 2020

(65) Prior Publication Data

US 2021/0172292 A1 Jun. 10, 2021

Related U.S. Application Data

(60) Provisional application No. 62/946,219, filed on Dec. 10, 2019.

(51) Int. Cl.
*E21B 41/00* (2006.01)
*E21B 23/12* (2006.01)
(Continued)

(52) U.S. Cl.
CPC ..... *E21B 41/0035* (2013.01); *E21B 17/18* (2013.01); *E21B 23/00* (2013.01);
(Continued)

(58) Field of Classification Search
CPC .. E21B 41/0035; E21B 41/0042; E21B 23/00; E21B 23/12; E21B 43/14
See application file for complete search history.

(56) References Cited

U.S. PATENT DOCUMENTS 5,435,392 A 7/1995 Kennedy
5,462,120 A * 10/1995 Gondouin ..... E21B 7/061 166/380
(Continued)

FOREIGN PATENT DOCUMENTS

CN 105089565 11/2015
CN 106471209 3/2017
(Continued)

OTHER PUBLICATIONS

Dyer, S., et al., "New Intelligent Completion System Enables Compartment-Level Control in Multilateral Wells," Journal of Petroleum Technology, Aug. 15, 2016, vol. 68, Issue 9, 6 pages, https://pubs.spe.org/en/jpt/jpt-article-detail/?art=1385.

*Primary Examiner* — Robert E Fuller
*Assistant Examiner* — Lamia Quaim
(74) *Attorney, Agent, or Firm* — Scott Richardson; Parker Justiss, P.C.

(57) ABSTRACT

Provided is a multilateral junction (MLT), a well system, and a method for forming a well system. The MLT, in one aspect, includes a y-block having a housing with a single first bore and second and third bores extending therein, the second and third bores defining second and third centerlines. The MLT, in this aspect, further includes a mainbore leg having a first mainbore leg end coupled to the second bore and a second opposing mainbore leg end, and a lateral bore leg having a first lateral bore leg end coupled to the third bore and a second opposing lateral bore leg end. In this aspect, the mainbore leg and the lateral bore leg are twisted with respect to the second and third bore such that a first plane taken
(Continued)

through centerlines of the second opposing mainbore leg end and the second opposing lateral bore leg end is angled.

20 Claims, 21 Drawing Sheets

(51) Int. Cl.

| | |
|---|---|
| ***E21B 23/00*** | (2006.01) |
| ***E21B 23/02*** | (2006.01) |
| ***E21B 43/26*** | (2006.01) |
| ***E21B 17/18*** | (2006.01) |
| *E21B 43/14* | (2006.01) |

(52) U.S. Cl.
CPC ..... *E21B 23/02* (2013.01); *E21B 41/0042* (2013.01); *E21B 43/26* (2013.01); *E21B 23/12* (2020.05); *E21B 43/14* (2013.01)

(56) References Cited

U.S. PATENT DOCUMENTS

| | | | |
|---|---|---|---|
| 5,979,560 | A | 11/1999 | Nobileau |
| 6,089,320 | A | 7/2000 | LaGrange |
| 6,907,930 | B2 | 6/2005 | Cavender et al. |
| 8,397,819 | B2 | 3/2013 | Tunget |
| 8,695,694 | B1 | 4/2014 | Lajesic |
| 8,701,775 | B2 | 4/2014 | Steele |
| 8,967,277 | B2 | 3/2015 | Steele et al. |
| 8,985,203 | B2 | 3/2015 | Stokes et al. |
| 9,133,697 | B2 | 9/2015 | Cavender et al. |
| 9,140,082 | B2 | 9/2015 | Lajesic |
| 9,140,102 | B2 | 9/2015 | Bartko et al. |
| 9,243,465 | B2 | 1/2016 | Lajesic |
| 9,260,945 | B2 | 2/2016 | Lajesic et al. |
| 9,638,008 | B2 | 5/2017 | Stokes et al. |
| 9,803,438 | B2 | 10/2017 | Stokes et al. |
| 9,822,612 | B2 | 11/2017 | Steele et al. |
| 9,874,062 | B2 | 1/2018 | Lajesic et al. |
| 10,012,045 | B2 | 7/2018 | Lajesic |
| 10,036,220 | B2 | 7/2018 | Lajesic et al. |
| 10,060,225 | B2 | 8/2018 | Wolf et al. |
| 10,167,684 | B2 | 1/2019 | Steele |
| 10,240,434 | B2 | 3/2019 | Steele et al. |
| 10,352,140 | B2 | 7/2019 | Parlin et al. |
| 10,435,993 | B2 | 10/2019 | Steele |
| 10,731,417 | B2 | 8/2020 | Vemuri et al. |
| 2001/0025710 | A1 | 10/2001 | Ohmer et al. |
| 2003/0062717 | A1 | 4/2003 | Thomas et al. |
| 2007/0089875 | A1 | 4/2007 | Steele et al. |
| 2007/0227727 | A1 | 10/2007 | Patel et al. |
| 2010/0163240 | A1 | 7/2010 | Ingraham et al. |
| 2010/0170677 | A1 | 7/2010 | Ingraham |
| 2010/0276158 | A1 | 11/2010 | Ingraham |
| 2013/0081807 | A1 | 4/2013 | Dyer et al. |
| 2014/0345861 | A1* | 11/2014 | Stalder ..... E21B 43/16 166/50 |
| 2015/0068756 | A1 | 3/2015 | Pendleton |
| 2015/0233190 | A1 | 8/2015 | Wolf et al. |
| 2015/0275587 | A1* | 10/2015 | Wolf ..... E21B 17/02 166/242.6 |
| 2015/0376955 | A1 | 12/2015 | Wolf et al. |
| 2016/0273312 | A1 | 9/2016 | Steele et al. |
| 2016/0290079 | A1* | 10/2016 | Lajesic ..... E21B 41/0035 |
| 2016/0348476 | A1 | 12/2016 | Stokes et al. |
| 2017/0328177 | A1 | 11/2017 | Sheehan et al. |

FOREIGN PATENT DOCUMENTS

| | | |
|---|---|---|
| CN | 105829639 | 5/2019 |
| EP | 2358974 | 10/2016 |
| EP | 2715041 | 1/2019 |
| EP | 3025005 B1 | 3/2019 |
| RU | 2436925 C2 | 12/2011 |
| RU | 2518701 C2 | 6/2014 |
| RU | 2588999 C2 | 7/2016 |
| RU | 2608375 C2 | 1/2017 |
| RU | 2655517 C2 | 5/2018 |
| RU | 2687729 C1 | 5/2019 |
| RU | 2719842 C2 | 4/2020 |
| WO | 2015030842 A1 | 3/2015 |
| WO | 2016010530 A1 | 1/2016 |
| WO | 2019027454 A1 | 2/2019 |

* cited by examiner

MULTILATERAL JUNCTION WITH TWISTED MAINBORE AND LATERAL BORE LEGS

CROSS-REFERENCE TO RELATED APPLICATION

This application claims the benefit of U.S. Provisional Application Ser. No. 62/946,219, filed on Dec. 10, 2019, entitled "HIGH PRESSURE MIC WITH MAINBORE AND LATERAL ACCESS AND CONTROL", and incorporated herein by reference in its entirety.

BACKGROUND

A variety of selective borehole pressure operations require pressure isolation to selectively treat specific areas of the wellbore. One such selective borehole pressure operation is horizontal multistage hydraulic fracturing ("frac" or "fracking"). In multilateral wells, the multistage stimulation treatments are performed inside multiple lateral wellbores. Efficient access to all lateral wellbores is critical to complete successful pressure stimulation treatment.

BRIEF DESCRIPTION

Reference is now made to the following descriptions taken in conjunction with the accompanying drawings, in which.

DETAILED DESCRIPTION

Figure 1:
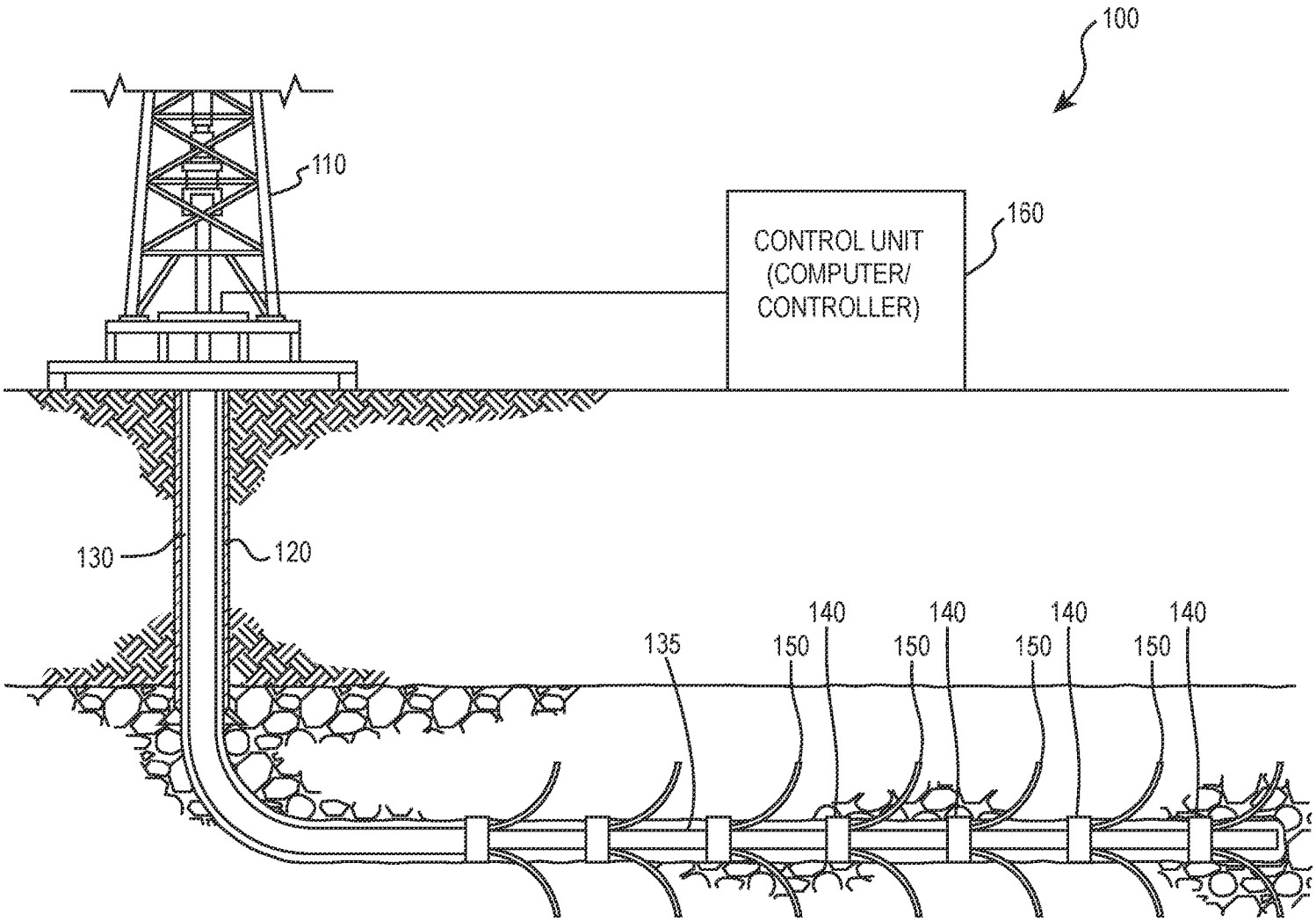
FIG. 1 illustrates a well system for hydrocarbon reservoir production, the well system including a y-block designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

A particular challenge for the oil and gas industry is developing a pressure tight TAML (Technology Advancement of Multilaterals) level 5 multilateral junction that can be installed in casing (e.g., 7⅝" casing) and that also allows for ID access (e.g., 3½" ID access) to a main wellbore after the junction is installed. This type of multilateral junction could be useful for coiled tubing conveyed stimulation and/or clean-up operations. It is envisioned that future multilateral wells will be drilled from existing slots/wells where additional laterals are added to the existing wellbore. If a side track can be made from the casing (e.g., 9⅝" casing), there is an option to install a liner (e.g., 7" or 7⅝" liner) with a new casing exit point positioned at an optimal location to reach undrained reserves.

Referring now to FIG. 1, illustrated is a diagram of a well system 100 for hydrocarbon reservoir production, according to certain example embodiments. The well system 100 in one or more embodiments includes a pumping station 110, a main wellbore 120, tubing 130, 135, which may have differing tubular diameters, and a plurality of multilateral junctions 140, and lateral legs 150 with additional tubing integrated with a main bore of the tubing 130, 135. Each multilateral junction 140 may comprise a junction designed, manufactured or operated according to the disclosure, including a twisted multilateral junction according to the disclosure. The well system 100 may additionally include a control unit 160. The control unit 160, in this embodiment, is operable to control to and/or from the multilateral junctions and/or lateral legs 150, as well as other devices downhole.

Figure 2:
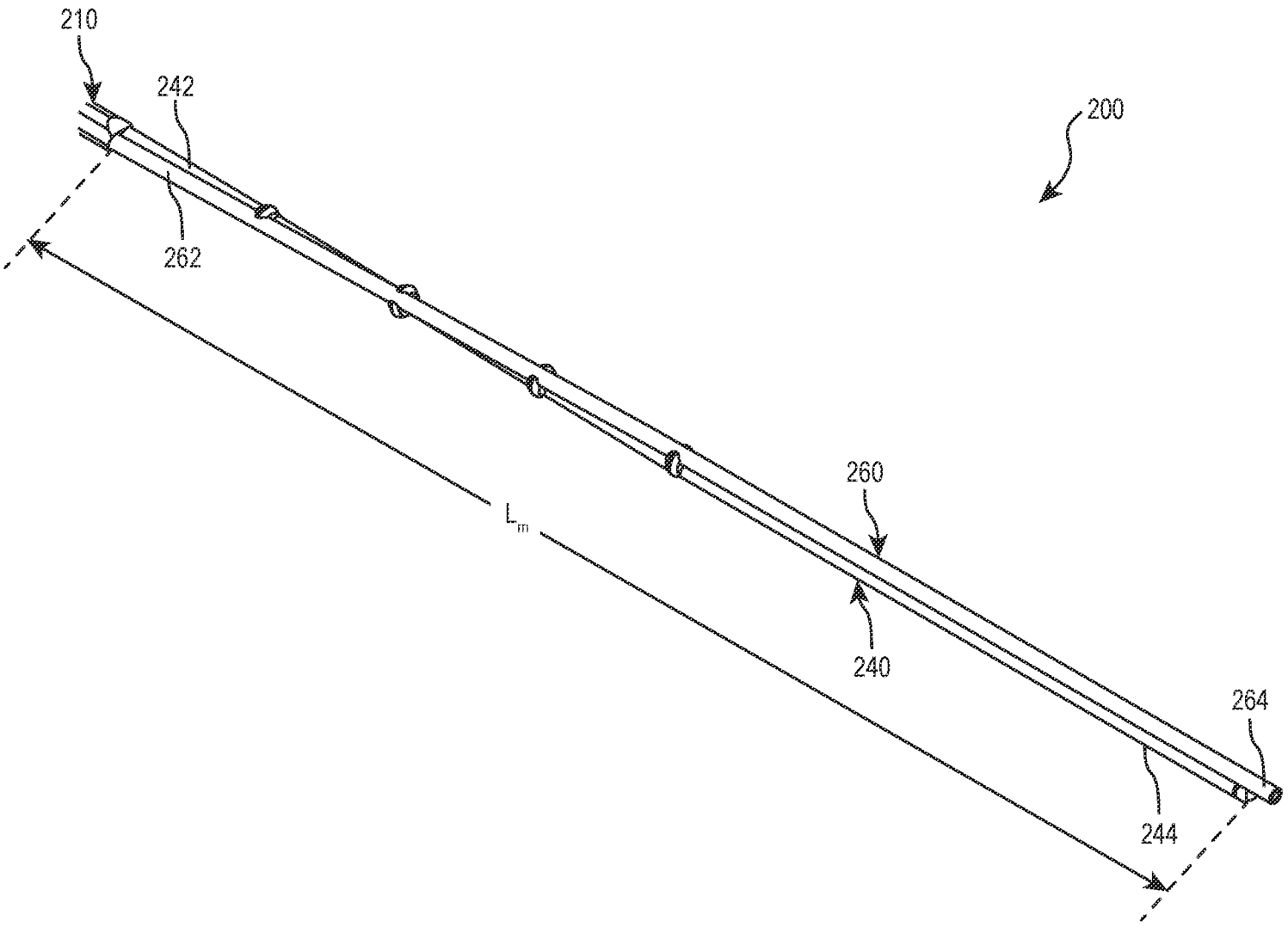
FIGS. 2 and 3 illustrate a perspective view and side view, respectively, of a multilateral junction designed, manufactured and operated according to one or more embodiments of the disclosure.
Figure 3:
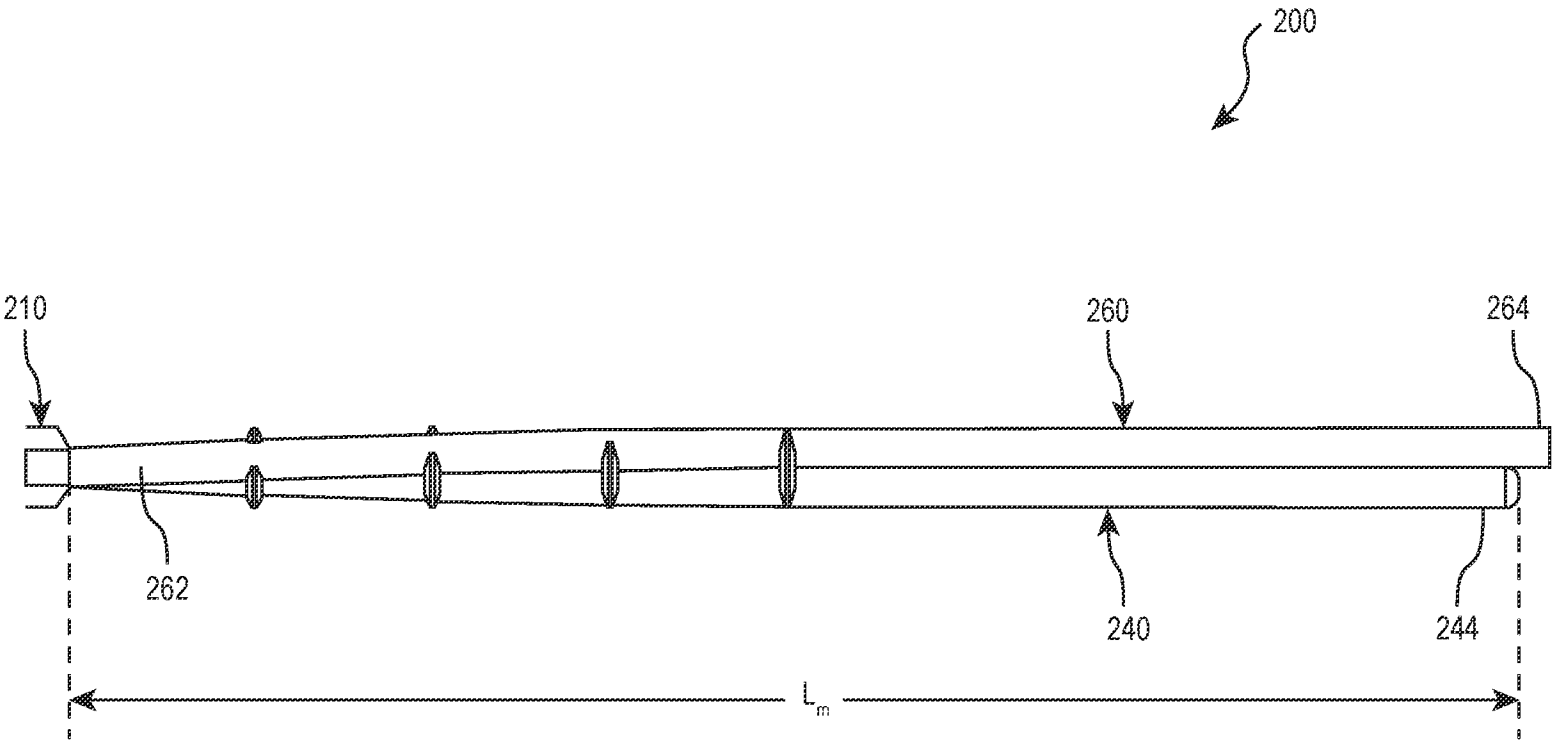

Turning to FIGS. 2 and 3, illustrated are a perspective view and side view, respectively, of a multilateral junction 200 designed, manufactured and operated according to one or more embodiments of the disclosure. The multilateral junction 200, in the illustrated embodiment, includes without limitation a y-block 210, a mainbore leg 240, and a lateral bore leg 260.

Figure 4A:
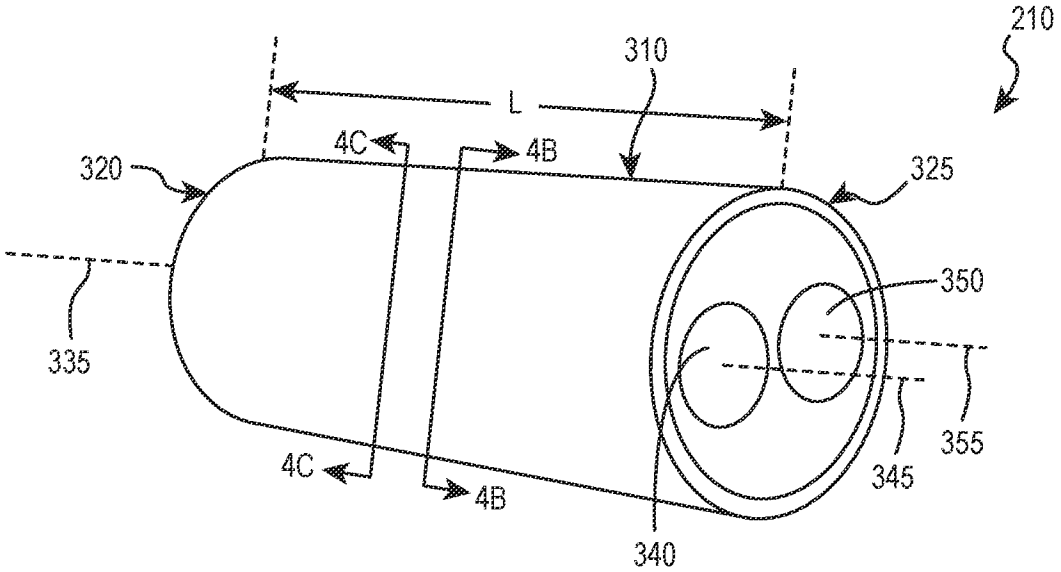
FIGS. 4A through 4F illustrate different views of different embodiments of the y-block illustrated in FIGS. 2 and 3.
Figure 4C:
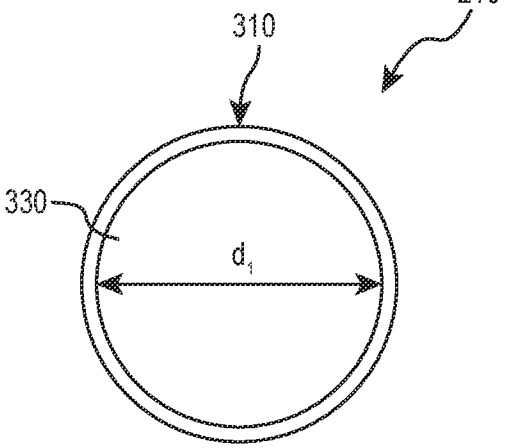
Figure 4B:
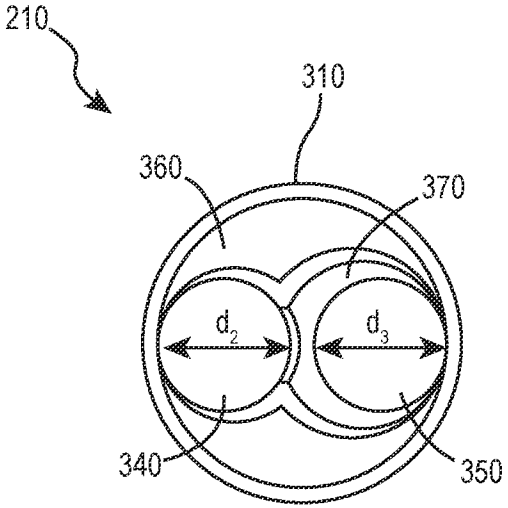

Turning briefly to FIGS. 4A through 4C, illustrated are different views of the y-block 210 illustrated in FIGS. 2 and 3. In the illustrated embodiments, FIG. 4A is an enlarged perspective view of one embodiment of the y-block 210, FIG. 4B is a cross-sectional view of the y-block 210 of FIG. 4A taken through the line 4B-4B, and FIG. 4C is a cross-sectional view of the y-block 210 of FIG. 4A taken through the line 4C-4C. The y-block 210, includes a housing 310.

For example, the housing 310 could be a solid piece of metal having been milled to contain various different bores according to the disclosure. In another embodiment, the housing 310 is a cast metal housing formed with the various different bores according to the disclosure. The housing 310, in accordance with one embodiment, may include a first end 320 and a second opposing end 325. The first end 320, in one or more embodiments, is a first uphole end, and the second end 325, in one or more embodiments, is a second downhole end.

The housing 310 may have a length (L), which in the disclosed embodiment is defined by the first end 320 and the second opposing end 325. The length (L) may vary greatly and remain within the scope of the disclosure. In one embodiment, however, the length (L) ranges from about 0.5 meters to about 4 meters. In yet another embodiment, the length (L) ranges from about 1.5 meters to about 2.0 meters, and in yet another embodiment the length (L) is approximately 1.8 meters (e.g., approximately 72 inches).

The y-block 210, in one or more embodiments, includes a single first bore 330 extending into the housing 310 from the first end 320. In the disclosed embodiment, the single first bore 330 defines a first centerline 335. The y-block 250, in one or more embodiments, further includes a second bore 340 and a third bore 350 extending into the housing 310. In the illustrated embodiment the second bore 340 and the third bore 350 branch off from the single first bore 330 at a point between the first end 320 and the second opposing end 325. In accordance with one embodiment of the disclosure, the second bore 340 defines a second centerline 345 and the third bore 350 defines a third centerline 355. The second centerline 345 and the third centerline 355 may have various different configurations relative to one another. In one embodiment the second centerline 345 and the third centerline 355 are parallel with one another. In another embodiment, the second centerline 345 and the third centerline 355 are angled relative to one another, and for example relative to the first centerline 335.

The single first bore 330, the second bore 340 and the third bore 350 may have different diameters and remain with the scope of the disclosure. In one embodiment, the single first bore 330 has a diameter ($d_1$). In one embodiment, the single first bore 260 has a diameter ($d_1$). The diameter ($d_1$) may range greatly, but in one or more embodiments the diameter ($d_1$) ranges from about 2.5 cm to about 60.1 cm (e.g., from about 1 inches to about 24 inches). The diameter ($d_1$), in one or more embodiments, ranges from about 7.6 cm to about 40.6 cm (e.g., from about 3 inches to about 16 inches). In yet another embodiment, the diameter ($d_1$) may range from about 15.2 cm to about 30.5 cm (e.g., from about 6 inches to about 12 inches). In yet another embodiment, the diameter ($d_1$) may range from about 17.8 cm to about 25.4 cm (e.g., from about 7 inches to about 10 inches), and more specifically in one embodiment a value of about 21.6 cm (e.g., about 8.5 inches).

In one embodiment, the second bore 340 has a diameter ($d_2$). The diameter ($d_2$) may range greatly, but in one or more embodiments the diameter ($d_2$) ranges from about 0.64 cm to about 50.8 cm (e.g., from about ¼ inches to about 20 inches). The diameter ($d_2$), in one or more embodiments, ranges from about 2.5 cm to about 17.8 cm (e.g., from about 1 inches to about 7 inches). In yet another embodiment, the diameter ($d_2$) may range from about 6.4 cm to about 12.7 cm (e.g., from about 2.5 inches to about 5 inches). In yet another embodiment, the diameter ($d_2$) may range from about 7.6 cm to about 10.2 cm (e.g., from about 3 inches to about 4 inches), and more specifically in one embodiment a value of about 8.9 cm (e.g., about 3.5 inches).

In one embodiment, the third bore 350 has a diameter ($d_3$). The diameter ($d_3$) may range greatly, but in one or more embodiments the diameter ($d_3$) ranges from about 0.64 cm to about 50.8 cm (e.g., from about ¼ inches to about 20 inches). The diameter ($d_3$), in one or more other embodiments, ranges from about 2.5 cm to about 17.8 cm (e.g., from about 1 inches to about 7 inches). In yet another embodiment, the diameter ($d_3$) may range from about 6.4 cm to about 12.7 cm (e.g., from about 2.5 inches to about 5 inches). In yet another embodiment, the diameter ($d_3$) may range from about 7.6 cm to about 10.2 cm (e.g., from about 3 inches to about 4 inches), and more specifically in one embodiment a value of about 8.9 cm (e.g., about 3.5 inches). Further to these embodiments, in certain circumstances the diameter ($d_2$) is the same as the diameter ($d_3$), and in yet other circumstances the diameter ($d_2$) is greater than the diameter ($d_3$).

The y-block 210 illustrated in FIGS. 4A through 4C, in at least one or more embodiments, additionally includes a deflector ramp 360 positioned at a junction between the single first bore 330 and the second and third separate bores 340, 350. In this embodiment, the deflector ramp 360 is configured to urge a downhole tool toward the third separate bore 350. The deflector ramp 360, in one or more embodiments, has a deflection angle (θ). The deflection angle (θ) may vary greatly and remain within the scope of the disclosure, but in certain embodiments the deflection angle (θ) is at least 30 degrees. In yet another embodiment, the deflection angle (θ) is at least 45 degree. While not clearly illustrated in FIGS. 4A through 4C, the deflector ramp 360 may be integral to the housing 310, or alternatively may be a deflector ramp insert.

In certain embodiments, an uphole end of the third bore 350 includes a sealing pocket 370. The sealing pocket 370, in this embodiment, is configured to engage with a nose of a downhole tool. For example, as the nose of a downhole tool rides up the deflector ramp 360, it would engage with the sealing pocket 370. In certain embodiments, the sealing pocket 370 provides a metal to metal seal with the downhole tool. In yet another embodiment, the y-block 210 additionally includes a sealing member (not shown) positioned in the sealing pocket 370. In regard to this embodiment, the sealing member would provide a fluid tight seal between the housing 310 and the downhole tool (not shown).

Figure 4D:
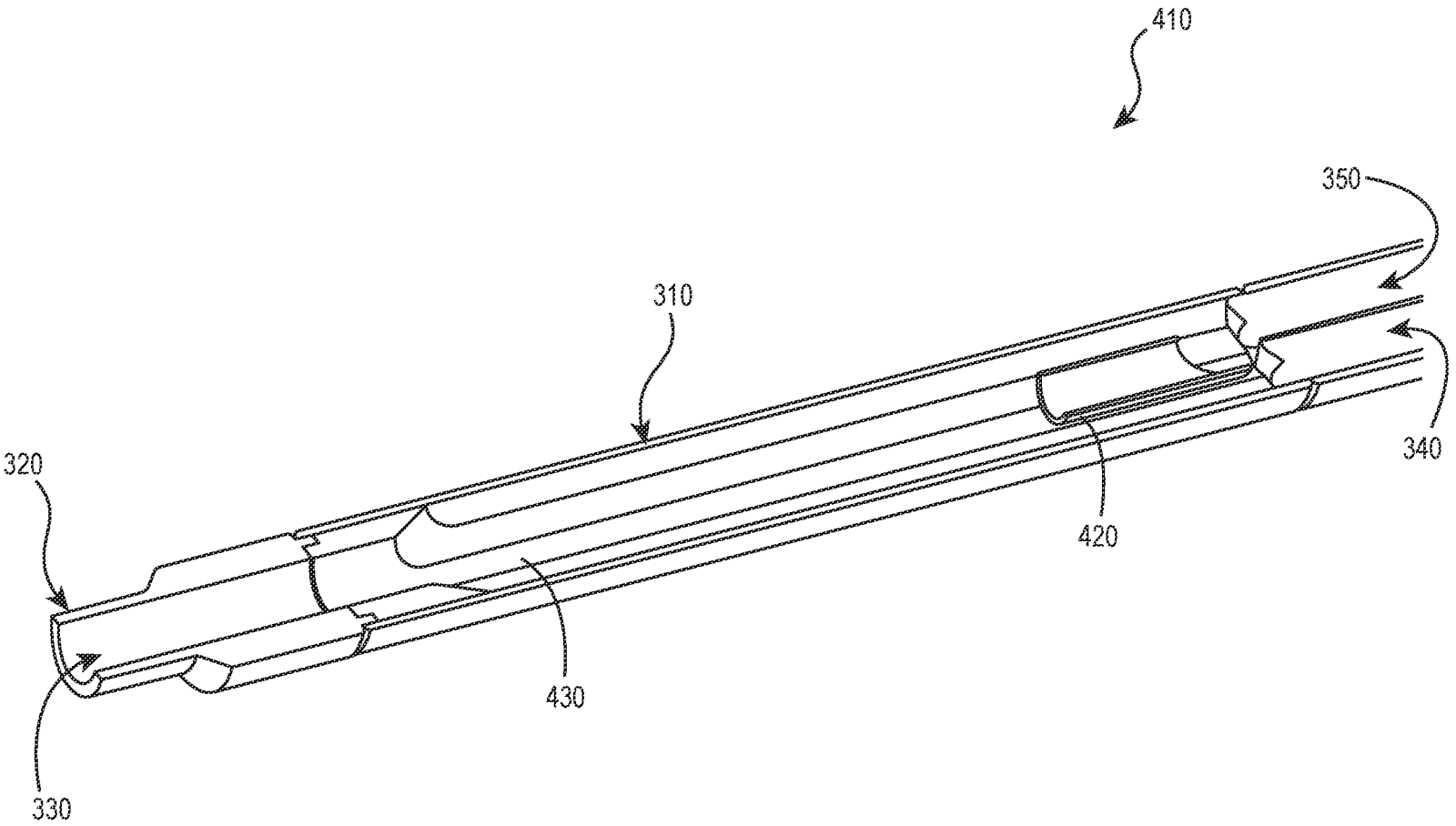
Figure 4E:
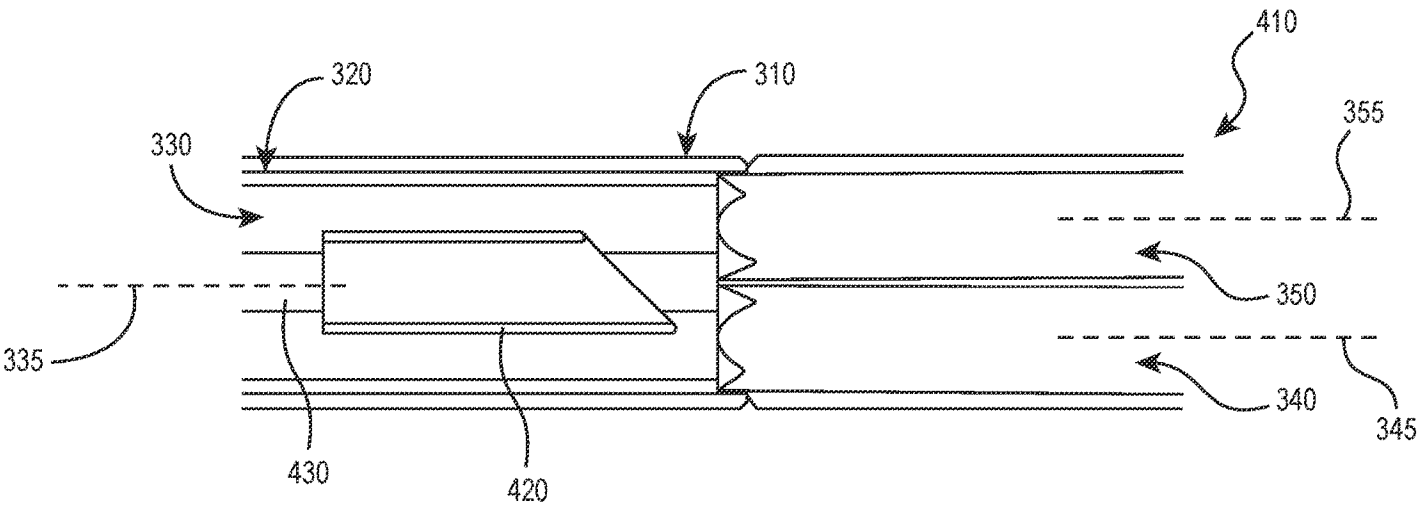
Figure 4F:
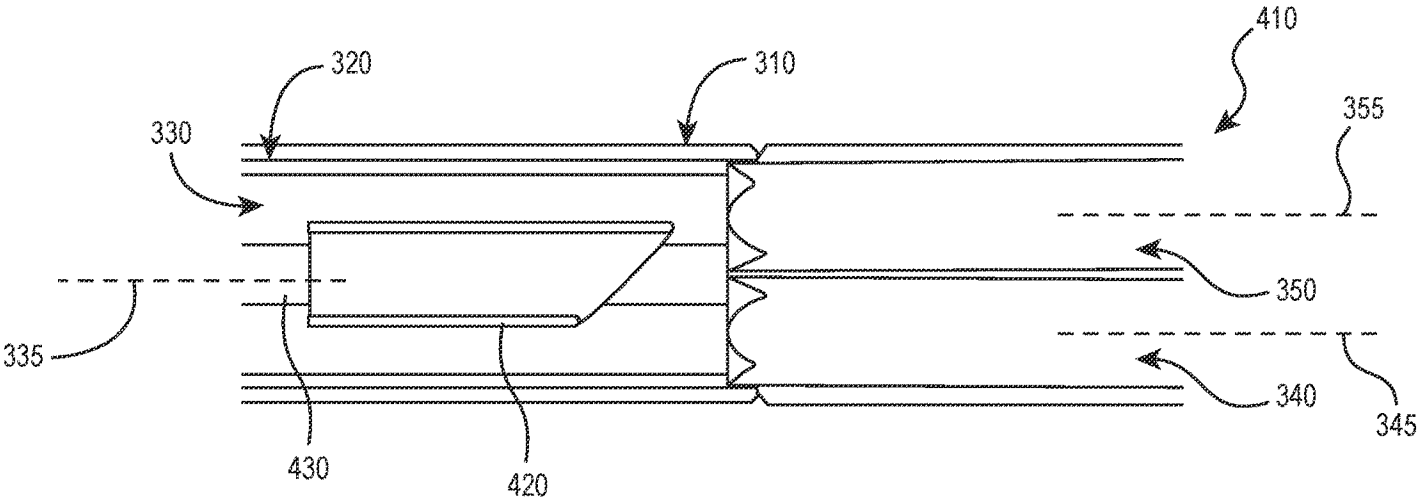

Turning briefly to FIGS. 4D through 4F, illustrated are different views of an alternative embodiment of a y-block 410. FIG. 4D is an enlarged cross-sectional perspective view of one embodiment of the y-block 410, FIG. 4E is a cross-sectional view of the y-block 410 with a downhole tool deflector device 420 in a first position (e.g., second bore 340 position), and FIG. 4F a cross-sectional view of the y-block 410 with the downhole tool deflector device 420 in a second position (e.g., third bore 350 position).

The y-block 410 of FIGS. 4D through 4F is similar in many respects to the y-block 210 illustrated in FIGS. 4A through 4C. Accordingly, like reference numbers have been used to illustrate similar, if not identical, features. The y-block 410 of FIGS. 4D through 4F differs, for the most part, from the y-block 210 illustrated in FIGS. 4A through 4C, in that it does not require intervention tools (e.g., such as the TEW, deflector sleeve, deflector ramp, etc.) to be installed inside of the y-block 410 to deflect downhole tools (e.g., such as a fracturing tool) into either the second bore 340 or the third bore 350. For instance, the y-block 410 of FIGS. 4D through 4F does not include the deflector ramp 360 or sealing pocket 370. In contrast, the deflector device 420 (e.g., a muleshoe in one embodiment) may be positioned on a tip of the downhole tool entering the y-block 410.

Since the second bore 340 and third bore 350 are positioned horizontally in the y-block 410, the downhole tool can easily be deflected into either of the 2 bores, depending on the orientation of the deflector device 420. The downhole tool and deflector device 420 will likely be positioned in a center of the y-block 410 (e.g., possibly within a center groove 430) when it passes thru the first end 320 of the y-block 410, and will stay centered until it is deflected into one of the second bore 340 or third bore 350.

Often, a rig operator will not know which of the second or third bores 340, 350, the downhole tool with the deflector device 420 entered until it reaches an indicating profile. For example, there may be an indicating profile in each bore, but at different distances, so the location of indication tells the rig operator which bore the tool is in. If the operator is in one bore, and wants the other, the operator may pick up on the downhole tool, rotate it by 180 degrees, and then go back into the other bore.

In those embodiments wherein the downhole tool including the deflector device 420 is coiled tubing, and for example is thus unable to rotate, the deflector device 420 could have an indexing feature. In this example, if it were determined that the downhole tool was in the wrong bore, the downhole tool and deflector device 420 could be pulled uphole or pushed further downhole (e.g., depending on the design of the deflector device 420), which would cause the deflector device 420 to engage with an indexing profile in the y-block 410, thereby rotating the deflector device 420 by approximately 180 degrees, wherein it could enter the other bore. As discussed above, FIG. 4E illustrates the deflector device 420 rotated in alignment with the second bore 340, whereas FIG. 4F illustrates the deflector device 420 rotated in alignment with the third bore 340.

Returning to FIGS. 2 and 3, with continued reference to FIGS. 4A through 4C, the mainbore leg 240 has a first mainbore leg end 242 coupled to the second bore 340 and a second opposing mainbore leg end 244. Similarly, the lateral bore leg 260 has a first lateral bore leg end 262 coupled to the third bore 350 and a second opposing lateral bore leg 264. In accordance with one or more embodiments, the mainbore leg 240 and the lateral bore leg 260 are twisted with respect to the second bore 340 and the third bore 350. For example, the mainbore leg 240 and the lateral bore leg 260 are twisted such that a first plane taken through centerlines of the second opposing mainbore leg end 244 and the second opposing lateral bore leg end 264 is angled by at least about ±15 degrees relative to a second plane taken through the second centerline 345 and the third centerline 355. The degree of angle may vary greatly and remain within the scope of the disclosure. For example, in another embodiment, the first plane is angled by at least about ±45 degrees relative to the second plane. In yet another example, the first plane is angled from about ±80 degrees to about to about ±90 degrees relative to the second plane. In even another embodiment, the first plane is angled by about ±90 degrees relative to the second plane. For example, in one or more embodiments, when the second plane is positioned substantially horizontally, the second opposing lateral bore leg end 264 of the lateral bore leg 260 is above the second opposing mainbore leg end 244 of the mainbore leg 240. In one or more other embodiments, when the second plane is positioned substantially horizontally, the second opposing lateral bore leg end 264 of the lateral bore leg 260 is directly above the second opposing mainbore leg end 244 of the mainbore leg 240.

As illustrated in FIGS. 2 and 3, the mainbore leg 240 has a length ($L_m$). The length ($L_m$) of the mainbore leg 240 may vary greatly and remain within the scope of the disclosure. In one embodiment, however, length ($L_m$) is at least about 2.54 m (e.g., about 100 inches). In yet another embodiment, length ($L_m$) ranges from about 3.8 m to about 20.3 m (e.g., ranging from about 150 inches to about 800 inches). In yet another embodiment, length ($L_m$) ranges from about 7.6 m to about 12.7 m (e.g., ranging from about 300 inches to about 500 inches), and in yet one specific embodiment the length ($L_m$) is about 10.2 m (e.g., about 400 inches).

In accordance with one or more embodiments of the disclosure, a twist of the mainbore leg 240 and the lateral bore leg 260 relative to the second bore 340 and the third bore 350 occurs within a first 80% of the length ($L_m$) (e.g., as measured from the y-block 210). In yet another embodiment, the twist of the mainbore leg 240 and the lateral bore leg 260 relative to the second bore 340 and the third bore 350 occurs within the first 50% of the length ($L_m$). In even yet another embodiment, the twist of the mainbore leg 240 and the lateral bore leg 260 relative to the second bore 340 and the third bore 350 occurs within the first 30% of the length ($L_m$).

Figure 5:
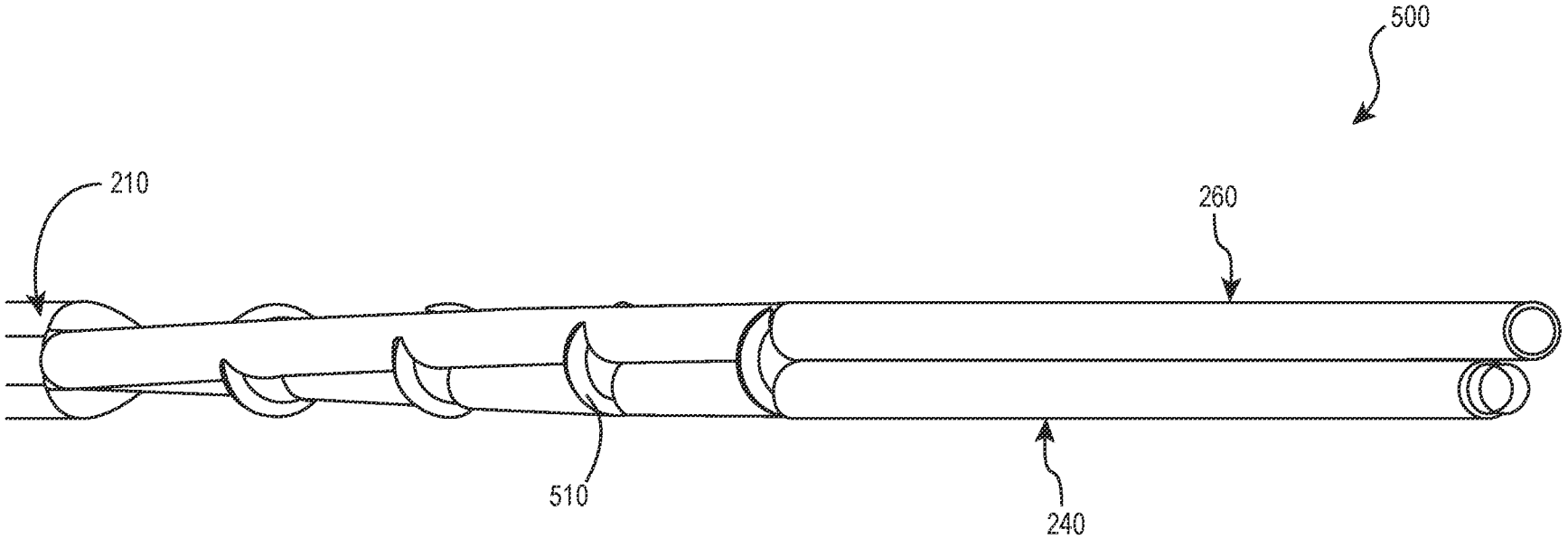
FIG. 5 illustrates an alternative embodiment of a multilateral junction designed, manufactured and operated according to the disclosure.

Turning now to FIG. 5, illustrated is an alternative embodiment of a multilateral junction 500 designed, manufactured and operated according to the disclosure. The multilateral junction 500 is similar in many respects to the multilateral junction 200 of FIGS. 2 and 3. Accordingly, like reference numbers have been used to indicate similar, if not identical, features. The multilateral junction 500 additionally includes one or more spacers 510 coupling the mainbore leg 240 to the lateral bore leg 260 for maintaining the twist. The one or more spacers 510, in one or more embodiments, at least partially surround the mainbore leg 240 and the lateral bore leg 260.

Figure 6:
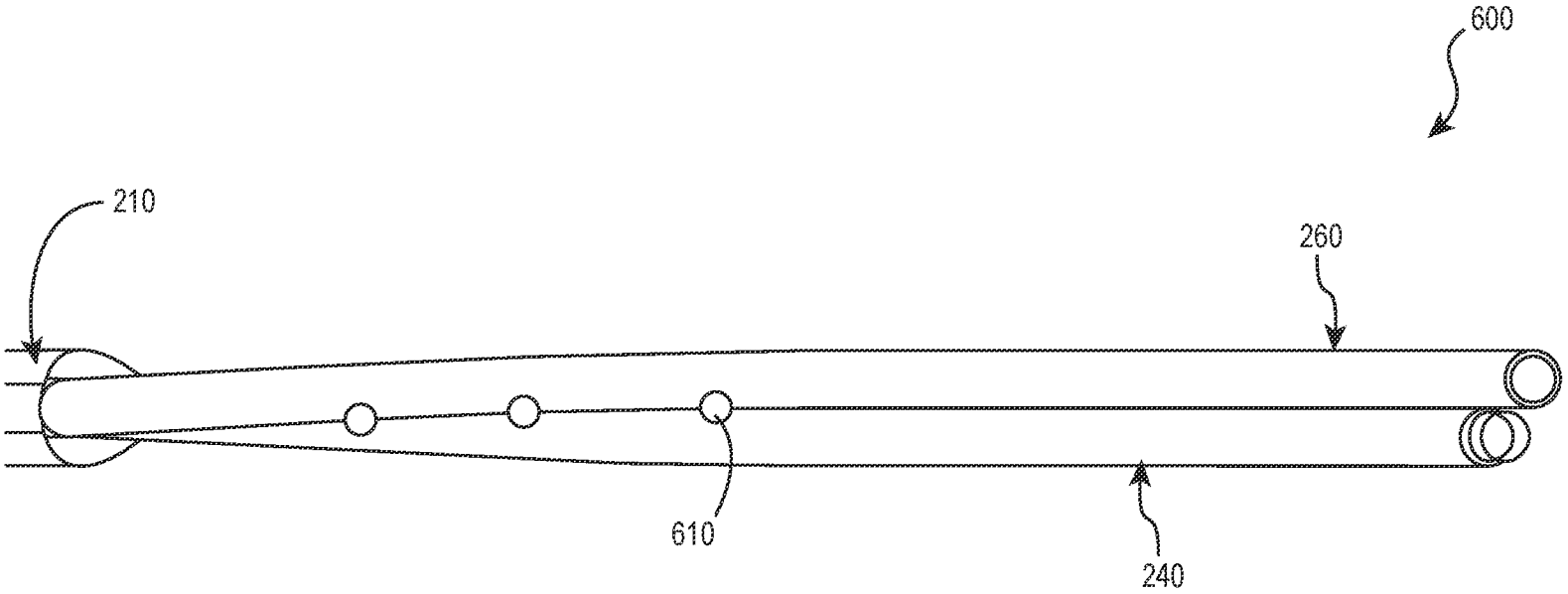
FIG. 6 illustrates yet an alternative embodiment of a multilateral junction designed, manufactured and operated according to the disclosure.

Turning now to FIG. 6, illustrated is an alternative embodiment of a multilateral junction 600 designed, manufactured and operated according to the disclosure. The multilateral junction 600 is similar in many respects to the multilateral junction 200 of FIGS. 2 and 3. Accordingly, like reference numbers have been used to indicate similar, if not identical, features. The multilateral junction 600 additionally includes one or more spot welds 610 coupling the mainbore leg 240 to the lateral bore leg 260 for maintaining the twist.

Figure 7:
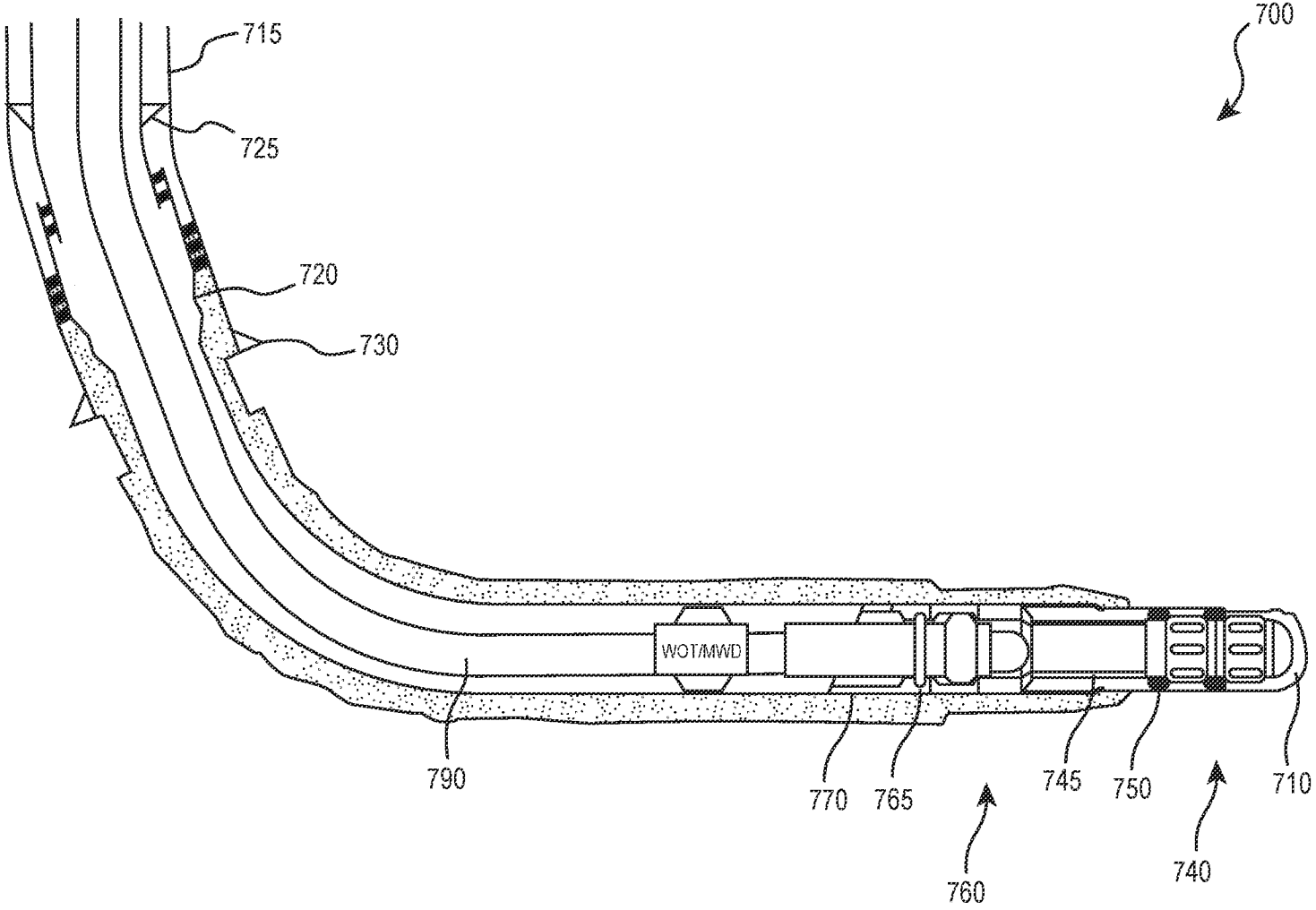
FIGS. 7 through 19 illustrate a method for forming, fracturing and/or producing from a well system.

Turning now to FIGS. 7 through 19, illustrated is a method for forming, intervening, fracturing and/or producing from a well system 700. FIG. 7 is a schematic of the well system 700 at the initial stages of formation. A main wellbore 710 may be drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730.

The well system 700 of FIG. 7 additionally includes a main wellbore completion 740 positioned in the main wellbore 710. The main wellbore completion 740 may, in certain embodiments, include a main wellbore liner 745 (e.g., with frac sleeves in one embodiment), as well as one or more packers 750 (e.g., swell packers in one embodiment). The main wellbore liner 745 and the one or more packer 750 may, in certain embodiments, be run on an anchor system 760. The anchor system 760, in one embodiment, includes a collet profile 765 for engaging with the running tool 790, as well as a muleshoe 770 (e.g., slotted alignment muleshoe). A standard workstring orientation tool (WOT) and measurement while drilling (MWD) tool may be coupled to the running tool 790, and thus be used to orient the anchor system 760.

Figure 8:
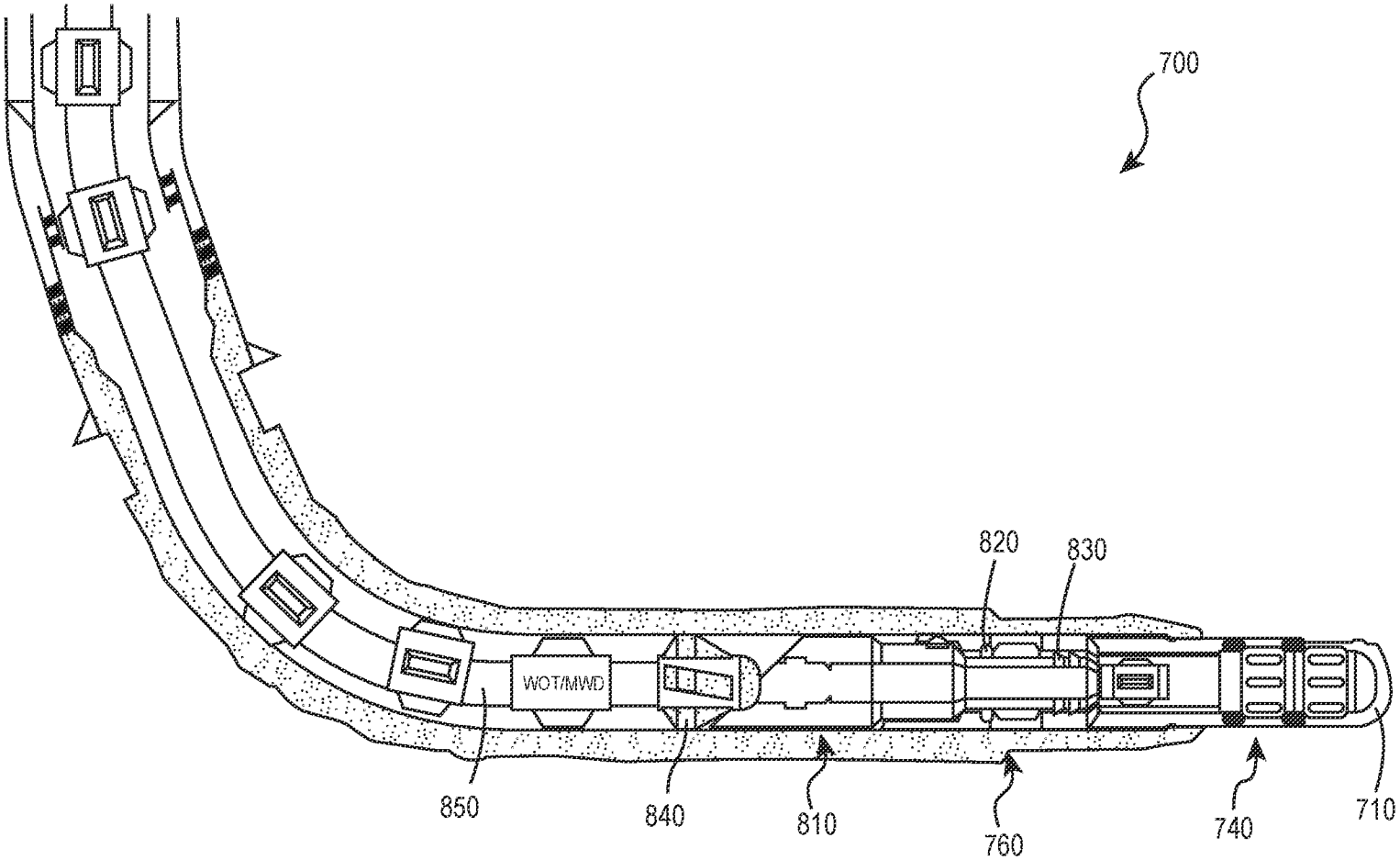

Turning to FIG. 8, illustrated is the well system 700 of FIG. 7 after positioning a whipstock assembly 810 downhole at a location where a lateral wellbore is to be formed. The whipstock assembly 810 includes a collet 820 for engaging the collet profile 765 in the anchor system 760. The whipstock assembly 810 additionally includes one or more seals 830 (e.g., a wiper set in one embodiment) to seal the whipstock assembly 810 with the main wellbore completion 740. In certain embodiments, such as that shown in FIG. 8, the whipstock assembly 810 is made up with a lead mill 840, for example using a shear bolt, and then run in hole on a drill string 850. The WOT/MWD tool may be employed to confirm the appropriate orientation of the whipstock assembly 810.

Figure 9:
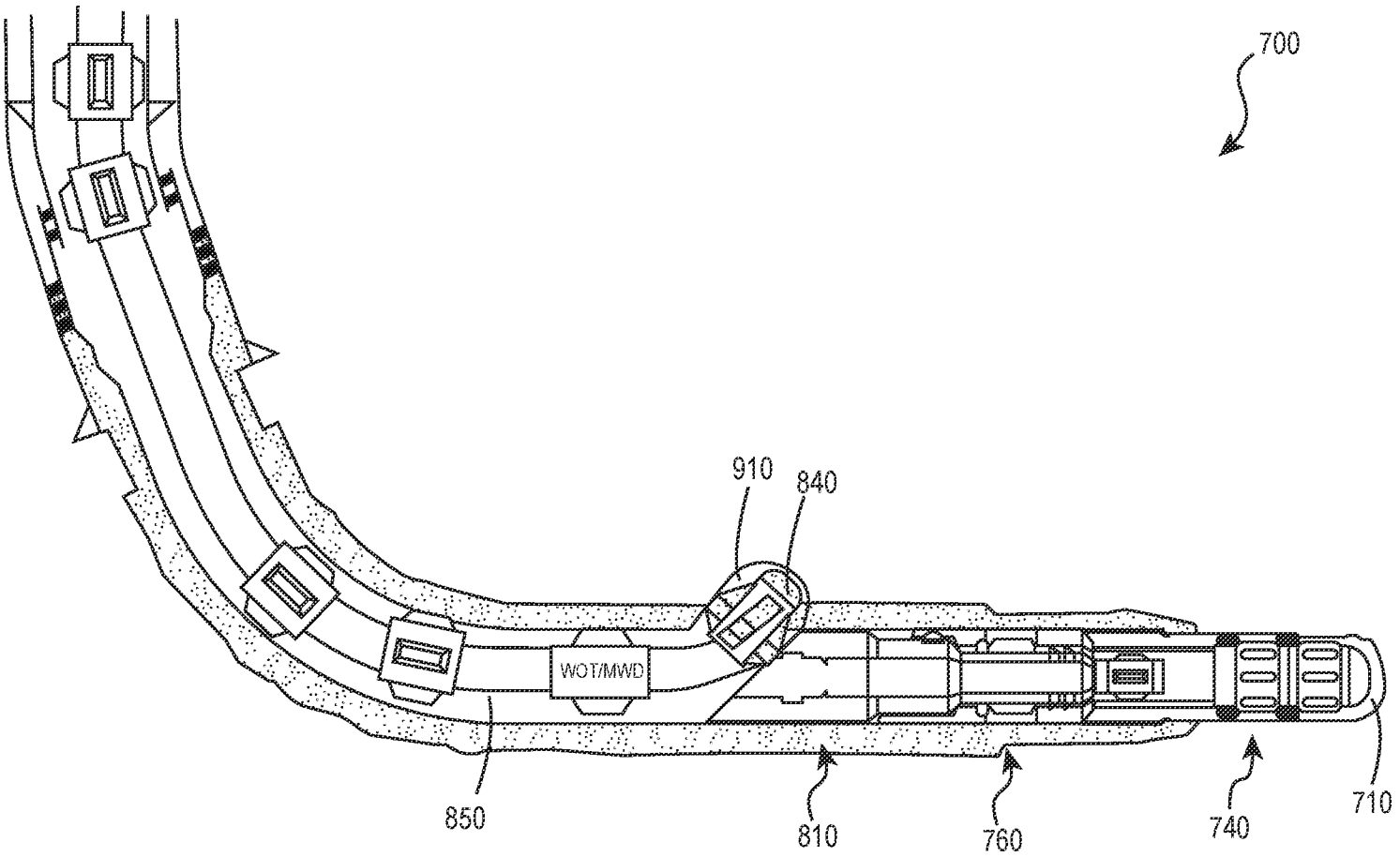

Turning to FIG. 9, illustrated is the well system 700 of FIG. 8 after setting down weight to shear the shear bolt between the lead mill 840 and the whipstock assembly 810, and then milling an initial window pocket 910. In certain embodiments, the initial window pocket 910 is between 1.5 m and 3.0 m long, and in certain other embodiments about 2.5 m long, and extends through the casing 720. Thereafter, a circulate and clean process could occur, and then the drill string 850 and lead mill 840 may be pulled out of hole.

Figure 10:
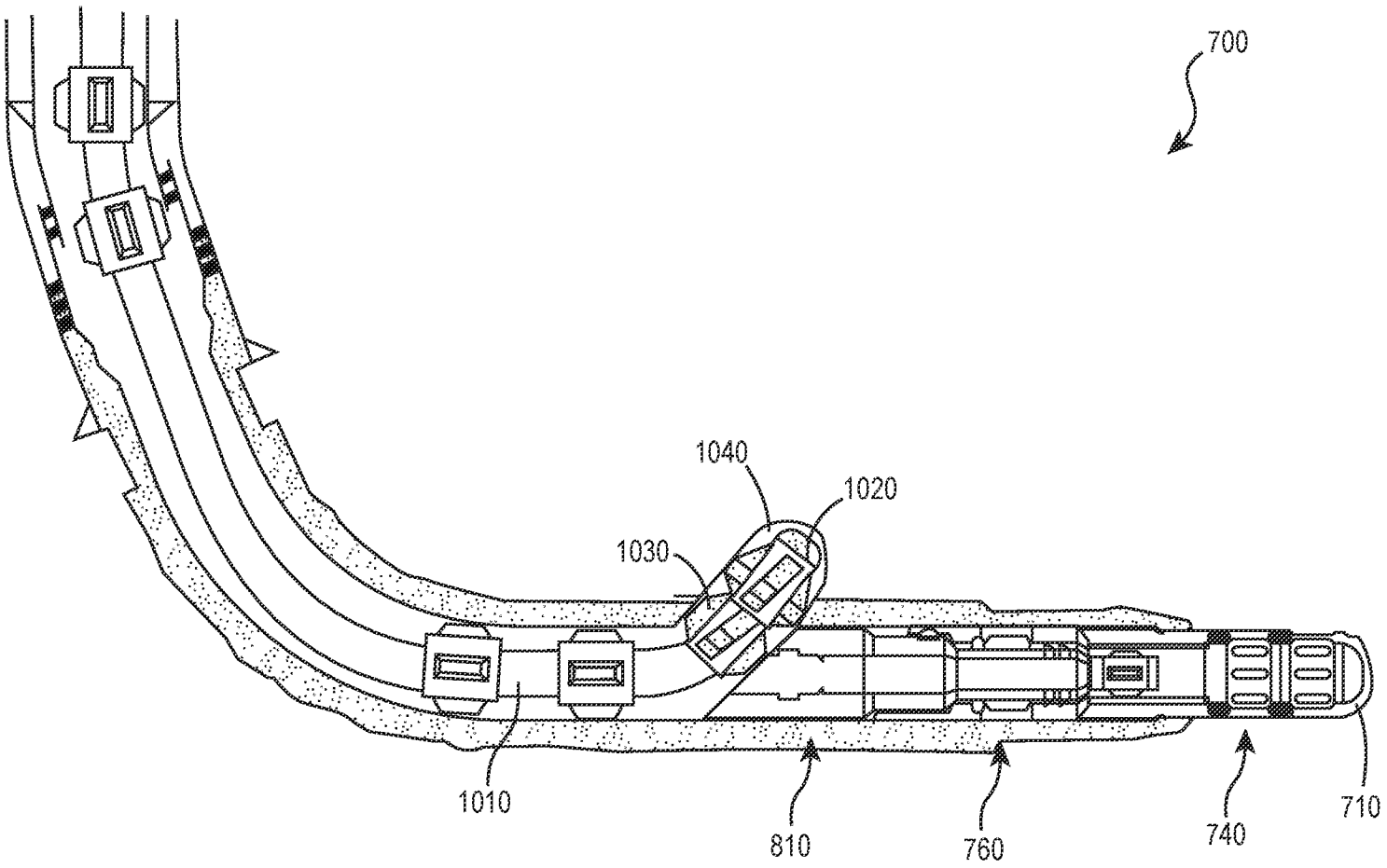

Turning to FIG. 10, illustrated is the well system 700 of FIG. 9 after running a lead mill 1020 and watermelon mill 1030 downhole on a drill string 1010. In the embodiments shown in FIG. 10, the drill string 1010, lead mill 1020 and watermelon mill 1030 drill a full window pocket 1040 in the formation. In certain embodiments, the full window pocket 1040 is between 6 m and 10 m long, and in certain other embodiments about 8.5 m long. Thereafter, a circulate and clean process could occur, and then the drill string 1010, lead mill 1020 and watermelon mill 1030 may be pulled out of hole.

Figure 11:
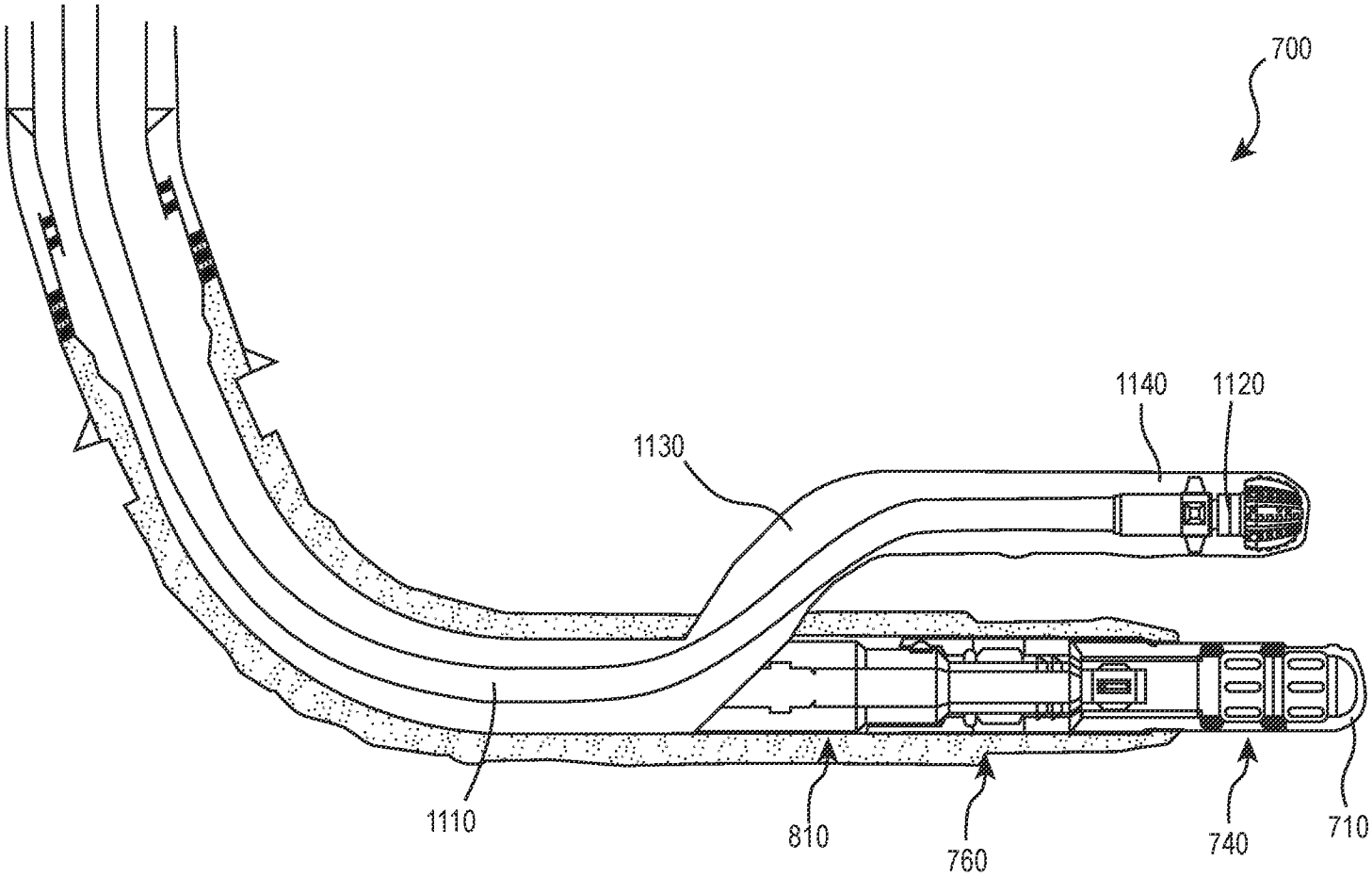

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole.

Figure 12:
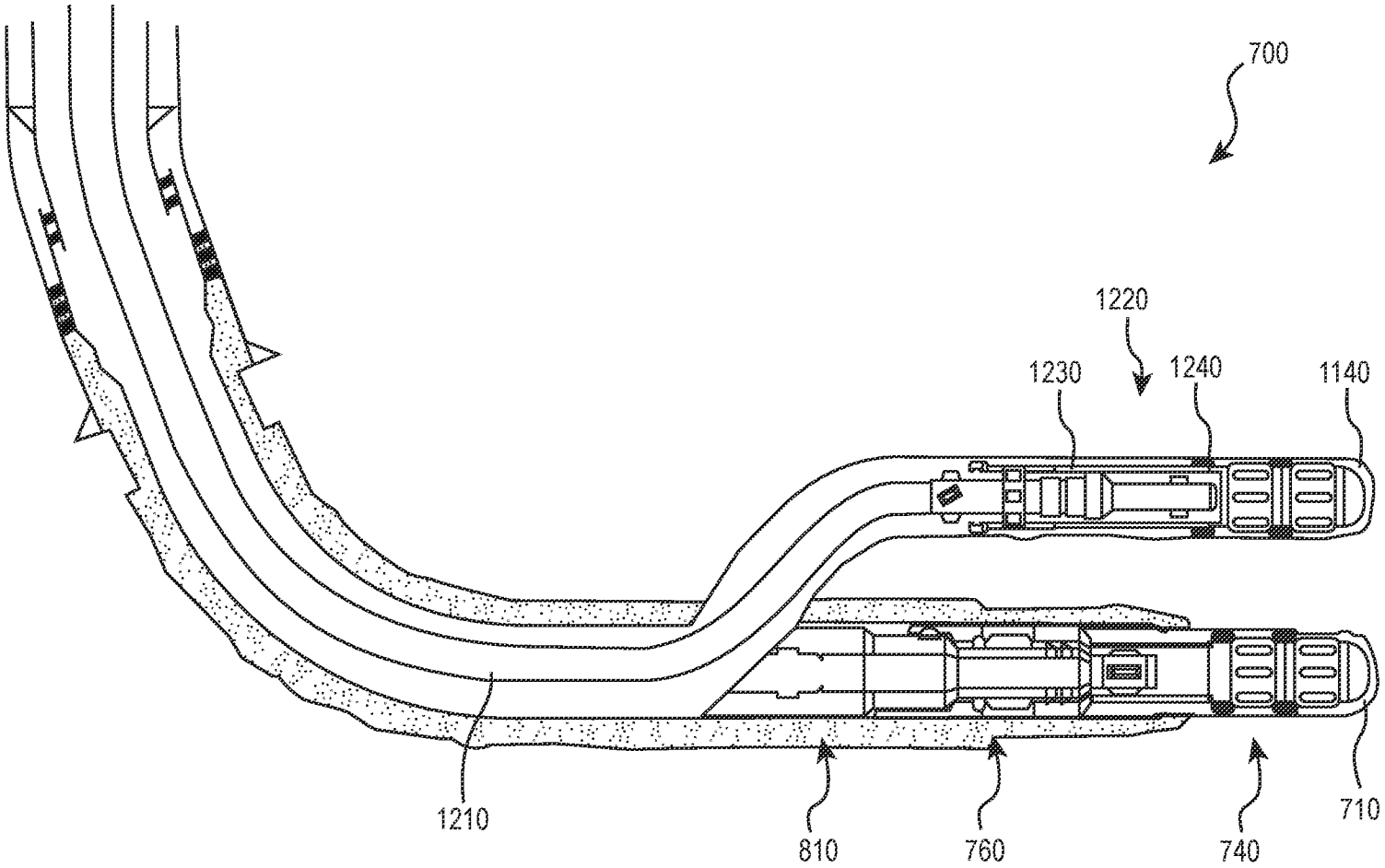

Turning to FIG. 12, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled into the main wellbore 710 for retrieval of the whipstock assembly 810.

Figure 13:
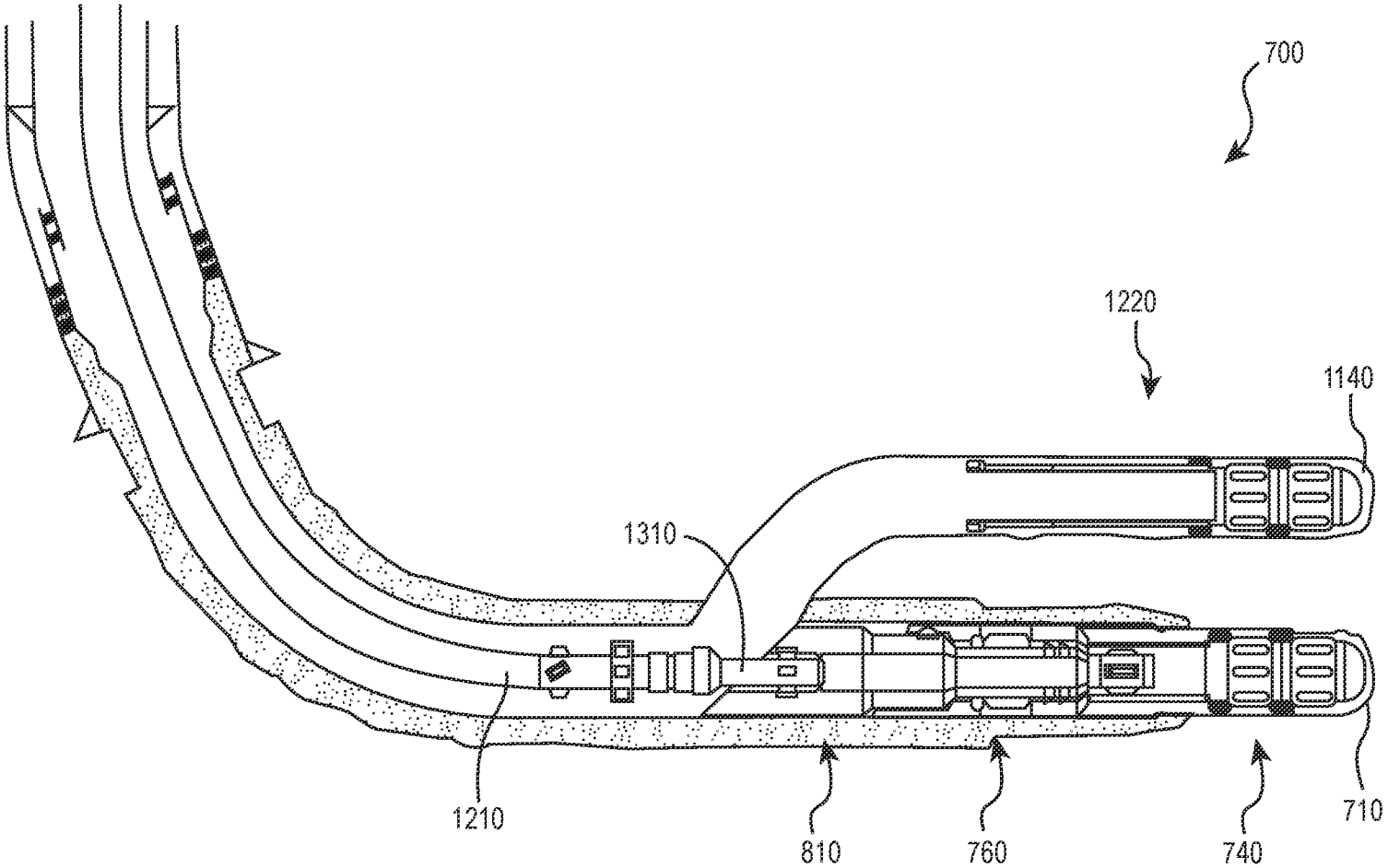

Turning to FIG. 13, illustrated is the well system 700 of FIG. 12 after latching a whipstock retrieval tool 1310 of the inner string 1210 with a profile in the whipstock assembly 810. The whipstock assembly 810 may then be pulled free from the anchor system 760, and then pulled out of hole. What results are the main wellbore completion 740 in the main wellbore 710, and the lateral wellbore completion 1220 in the lateral wellbore 1140.

Figure 14:
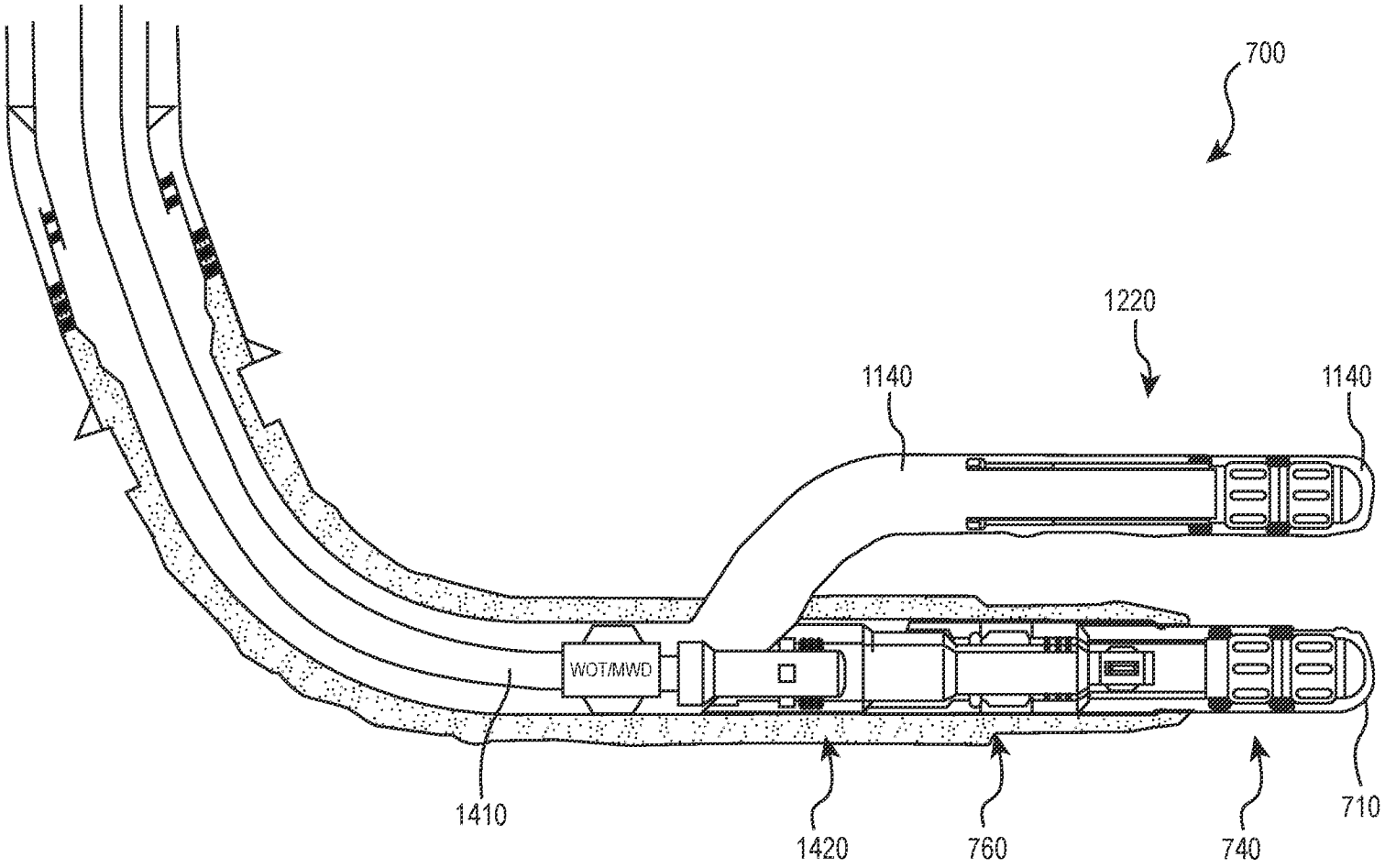

Turning to FIG. 14, illustrated is the well system 700 of FIG. 13 after employing a running tool 1410 to install a deflector assembly 1420 proximate a junction between the main wellbore 710 and the lateral wellbore 1140. The deflector assembly 1420 may be appropriately oriented using the WOT/MWD tool. The running tool 1410 may then be pulled out of hole.

Figure 15:
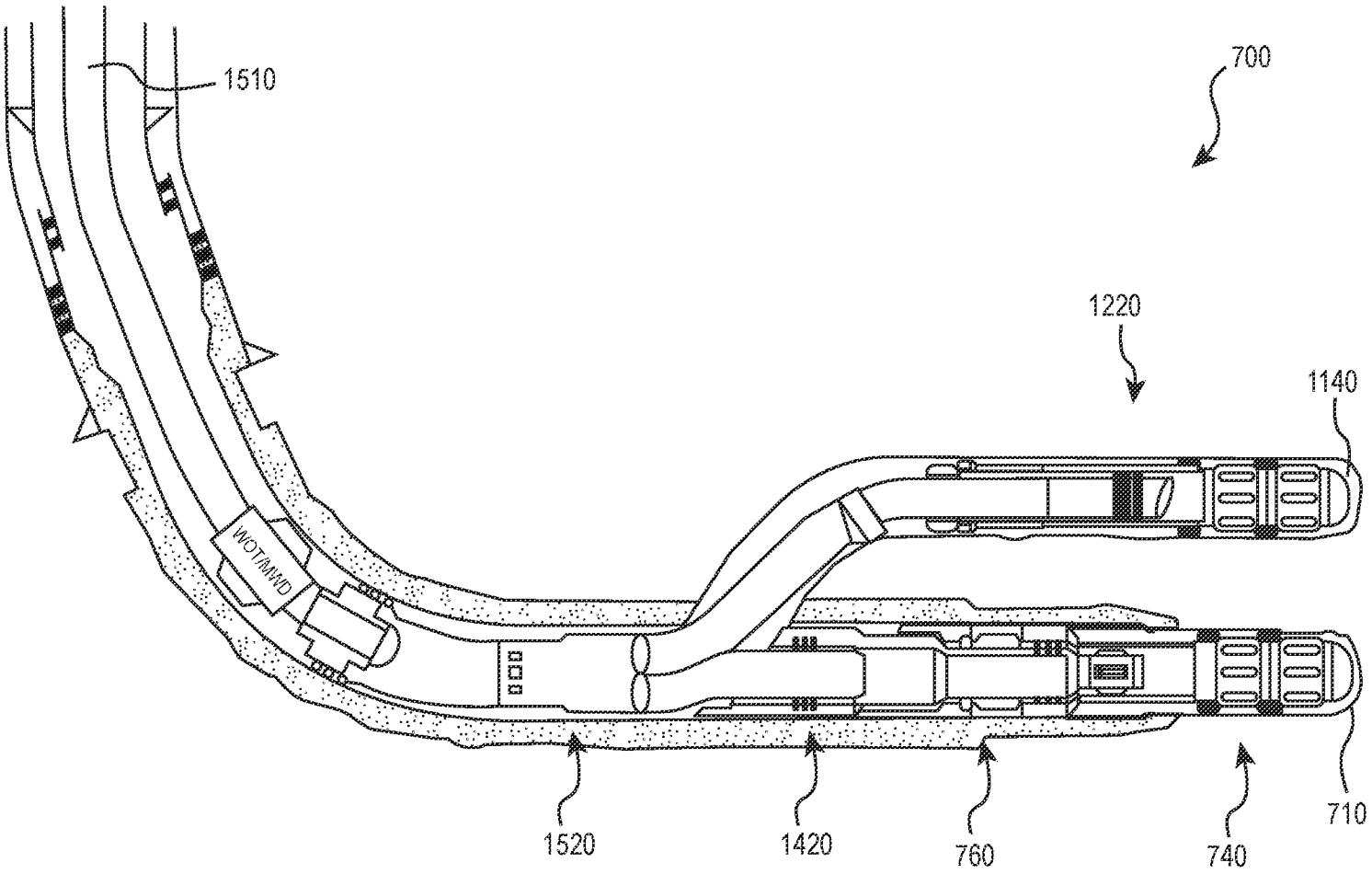

Turning to FIG. 15, illustrated is the well system 700 of FIG. 14 after employing a running tool 1510 to place a multilateral junction 1520 proximate an intersection between the main wellbore 710 and the lateral wellbore 1410. In accordance with one embodiment, the multilateral junction 1520 could be similar to one or more of the multilateral junctions discussed above with respect to FIGS. 2 through 6. Accordingly, while to clearly illustrated in the embodiment of FIG. 15 as result of the scale of the drawings, the multilateral junction 1520 could have the aforementioned twists, as well as the above-discussed y-block. In the illustrated embodiment, once the multilateral junction 1520 is in place the second plane would be substantially horizontal, wherein the first plane would be substantially vertical. The term substantial, as used with respect to the horizontal or vertical nature of a feature means within ±5 degrees from perfectly horizontal or vertical. However, in certain embodiments, the multilateral junction 1520 is run in hole with the second plane in a first substantially vertical position, before rotating the multilateral junction 1520 when it approaches the intersection such that the second plane is in a second substantially horizontal position.

Figure 16:
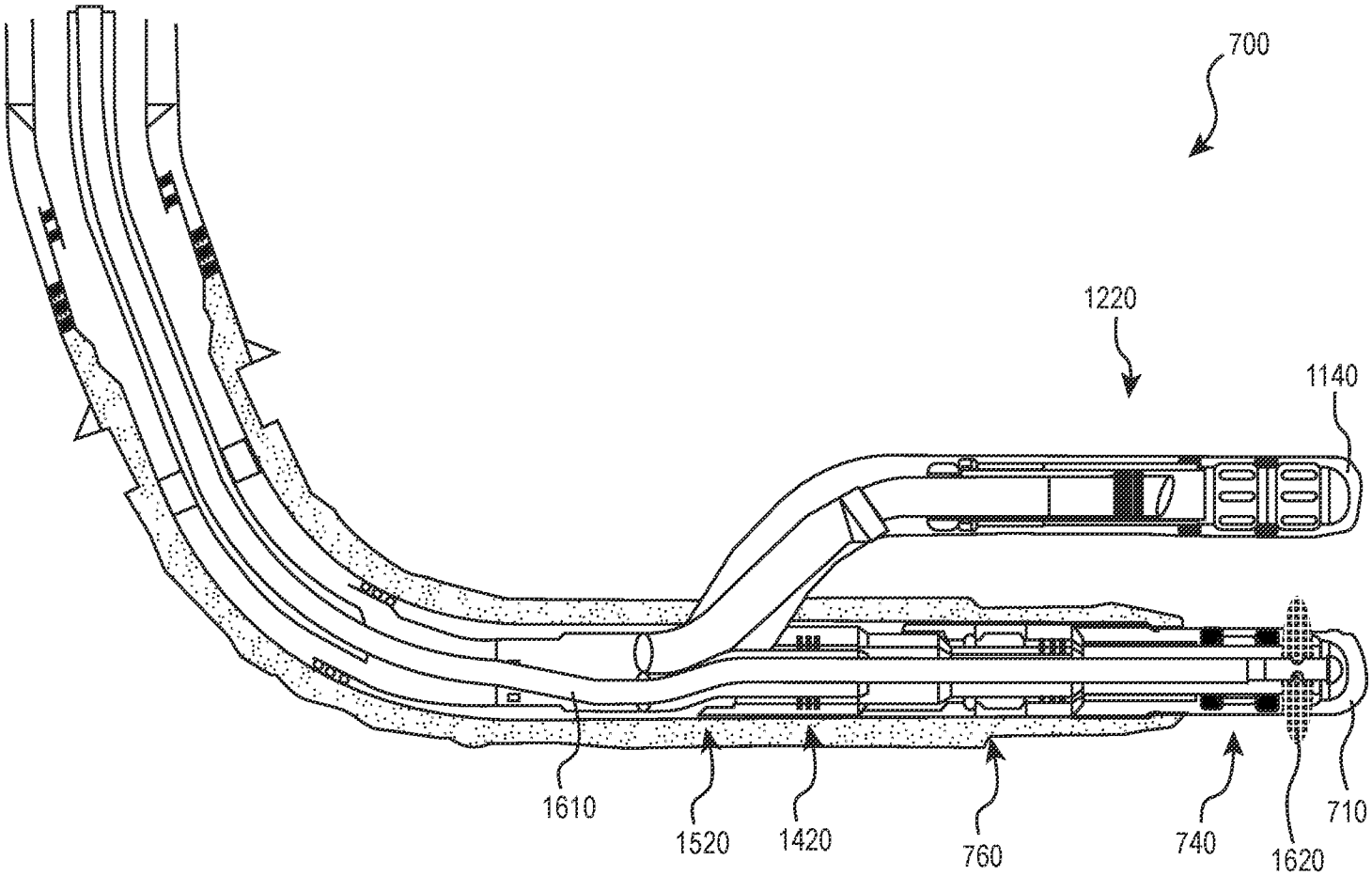

Turning to FIG. 16, illustrated is the well system 700 of FIG. 15 after selectively accessing the main wellbore 710 with a first intervention tool 1610 through the y-block of the multilateral junction 1520. In the illustrated embodiment, the first intervention tool 1610 is a fracturing tool, and more particularly a coiled tubing conveyed fracturing tool. With the first intervention tool 1610 in place, fractures 1620 in the subterranean formation surrounding the main wellbore completion 740 may be formed. Thereafter, the first intervention tool 1610 may be pulled from the main wellbore completion 740.

Figure 17:
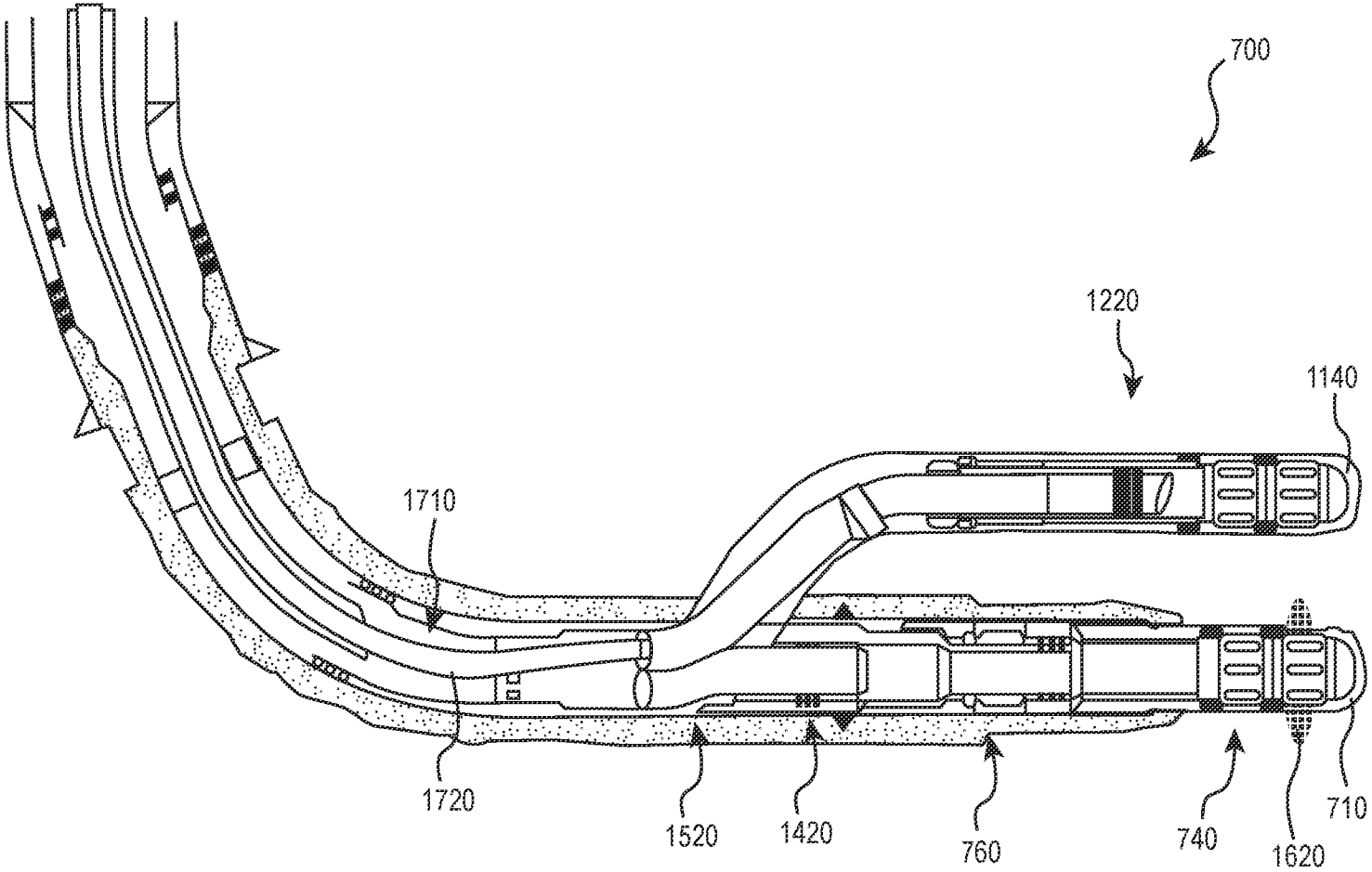

Turning to FIG. 17, illustrated is the well system 700 of FIG. 16 after positioning a downhole tool 1710 within the multilateral junction 1520 including the y-block. In the illustrated embodiment, the downhole tool 1710 is a fracturing tool, and more particularly a coiled tubing conveyed fracturing tool.

Figure 18:
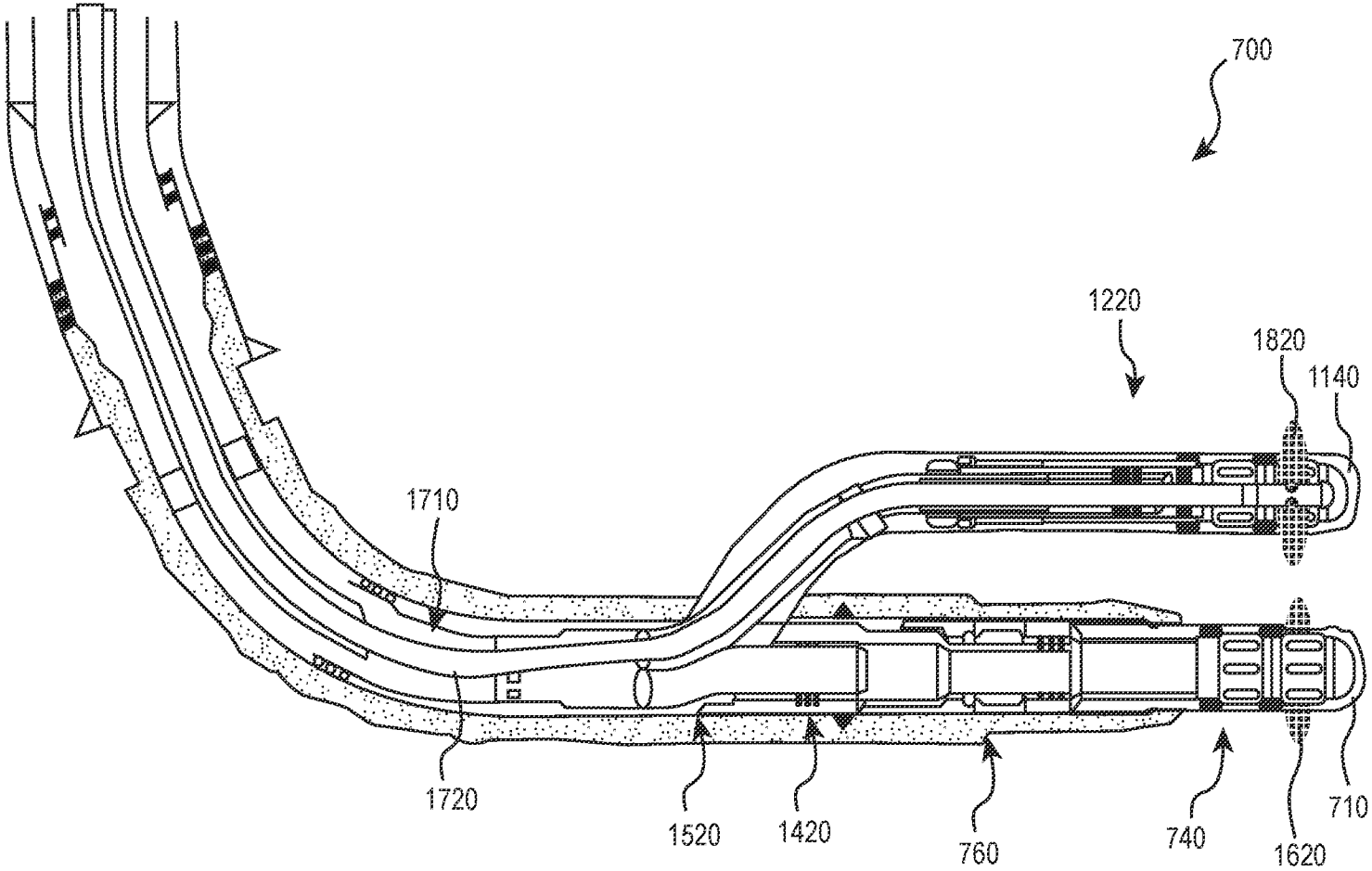

Turning to FIG. 18, illustrated is the well system 700 of FIG. 17 after putting additional weight down on the second intervention tool 1710 and causing the second intervention tool 1710 to enter the lateral wellbore 1140. With the downhole tool 1710 in place, fractures 1820 in the subterranean formation surrounding the lateral wellbore completion 1220 may be formed. In certain embodiments, the first intervention tool 1610 and the second intervention tool 1710 are the same intervention tool. Thereafter, the second intervention tool 1710 may be pulled from the lateral wellbore completion 1220 and out of the hole.

Figure 19:
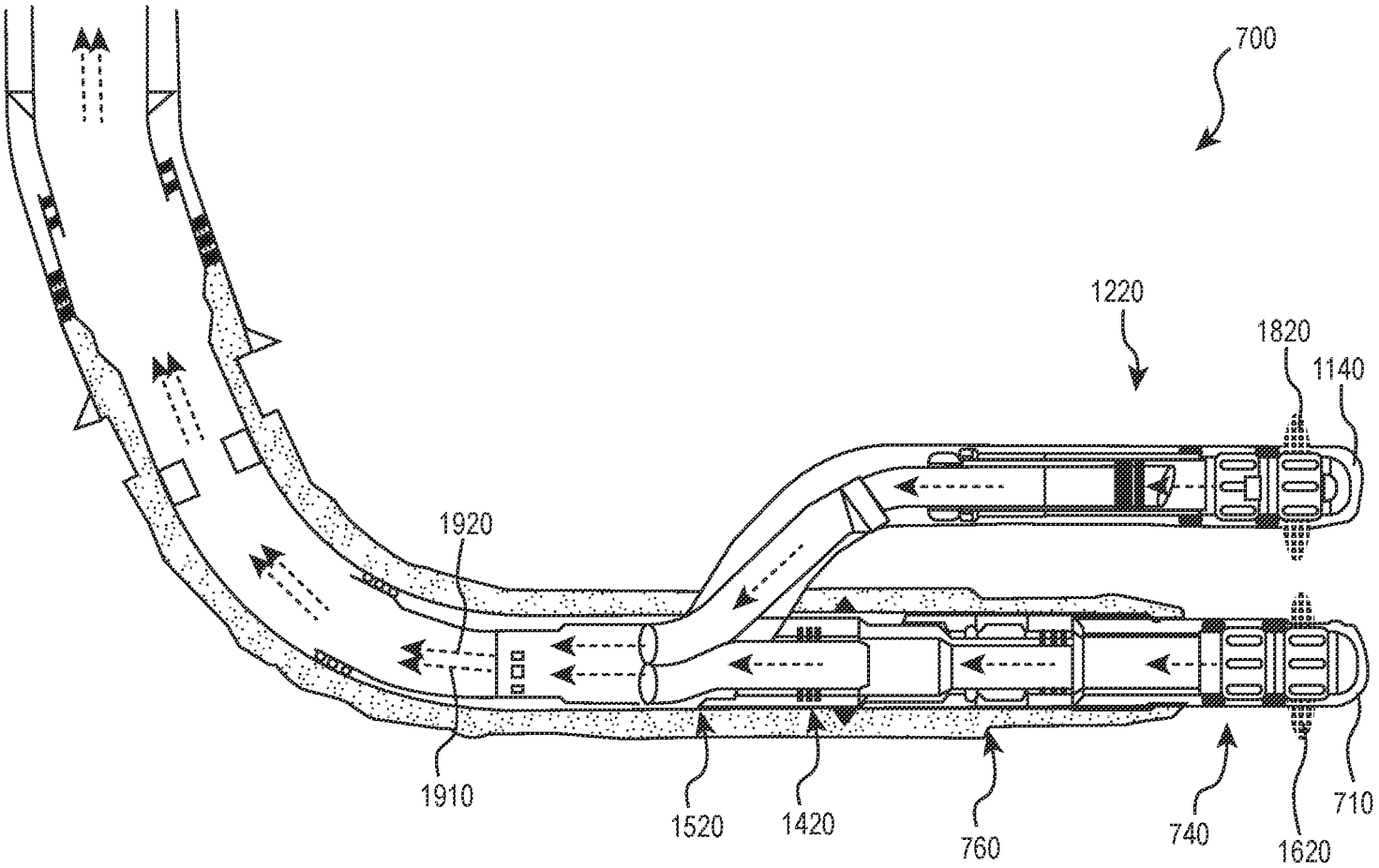

Turning to FIG. 19, illustrated is the well system 700 of FIG. 18 after producing fluids 1910 from the fractures 1620 in the main wellbore 710, and producing fluids 1920 from the fractures 1820 in the lateral wellbore 1140. The producing of the fluids 1910, 1920 occur through the multilateral junction 1520, and more specifically through the y-block design, manufactured and operated according to one or more embodiments of the disclosure.

Aspects disclosed herein include:

A. A multilateral junction, the multilateral junction including: 1) a y-block, the y-block including; a) a housing having a first end and a second opposing end; b) a single first bore extending into the housing from the first end, the single first bore defining a first centerline; and c) second and third separate bores extending into the housing and branching off from the single first bore, the second bore defining a second centerline and the third bore defining a third centerline; 2) a mainbore leg having a first mainbore leg end coupled to the second bore and a second opposing mainbore leg end; and 3) a lateral bore leg having a first lateral bore leg end coupled to the third bore and a second opposing lateral bore leg end, the mainbore leg and the lateral bore leg twisted with respect to the second bore and the third bore such that a first plane taken through centerlines of the second opposing mainbore leg end and the second opposing lateral bore leg end is angled by at least about ±15 degrees relative to a second plane taken through the second centerline and the third centerline.

B. A well system, the well system including: 1) a main wellbore; 2) a lateral wellbore extending from the main wellbore; 3) a multilateral junction positioned at an intersection of the main wellbore and the lateral wellbore, the multilateral junction including; a) a y-block, the y-block including; i) a housing having a first end and a second opposing end; ii) a single first bore extending into the housing from the first end, the single first bore defining a first centerline; and iii) second and third separate bores extending into the housing and branching off from the single first bore, the second bore defining a second centerline and the third bore defining a third centerline; b) a mainbore leg having a first mainbore leg end coupled to the second bore and a second opposing mainbore leg end in the main wellbore; and c) a lateral bore leg having a first lateral bore leg end coupled to the third bore and a second opposing lateral bore leg end in the lateral wellbore, the mainbore leg and the lateral bore leg twisted with respect to the second bore and the third bore such that a first plane taken through centerlines of the second opposing mainbore leg end and the second opposing lateral bore leg end is angled by at least about ±15 degrees relative to a second plane taken through the second centerline and the third centerline C. A method for forming a well system, the method including: 1) placing a multilateral junction proximate an intersection between a main wellbore and a lateral wellbore, the multilateral junction including; a) a y-block, the y-block including; i) a housing having a first end and a second opposing end; ii) a single first bore extending into the housing from the first end, the single first bore defining a first centerline; and iii) second and third separate bores extending into the housing and branching off from the single first bore, the second bore defining a second centerline and the third bore defining a third centerline; b) a mainbore leg having a first mainbore leg end coupled to the second bore and a second opposing mainbore leg end in the main wellbore; and c) a lateral bore leg having a first lateral bore leg end coupled to the third bore and a second opposing lateral bore leg end in the lateral wellbore, the mainbore leg and the lateral bore leg twisted with respect to the second bore and the third bore such that a first plane taken through centerlines of the second opposing mainbore leg end and the second opposing lateral bore leg end is angled by at least about ±15 degrees relative to a second plane taken through the second centerline and the third centerline.

Aspects A, B, and C may have one or more of the following additional elements in combination: Element 1: wherein the first plane is angled by at least about ±45 degrees relative to the second plane. Element 2: wherein the first plane is angled from about ±80 degrees to about to about ±90 degrees relative to the second plane. Element 3: wherein the first plane is angled by about ±90 degrees relative to the second plane. Element 4: wherein the mainbore leg has a length ($L_m$), and further wherein a twist of the mainbore leg and the lateral bore leg relative to the second bore and the third bore occurs within a first 80% of the length ($L_m$). Element 5: wherein the twist of the mainbore leg and the lateral bore leg relative to the second bore and the third bore occurs within the first 50% of the length ($L_m$). Element 6: wherein the twist of the mainbore leg and the lateral bore leg relative to the second bore and the third bore occurs within the first 30% of the length ($L_m$). Element 7: further including one or more spacers coupling the mainbore leg to the lateral bore leg for maintaining the twist. Element 8: wherein the one or more spacers at least partially surround the mainbore leg and the lateral bore leg. Element 9: further including one or more spot welds coupling the mainbore leg and the lateral bore leg for maintaining the twist. Element 10: wherein the first plane is angled from about ±80 degrees to about to about ±90 degrees relative to the second plane. Element 11: wherein the second plane is less than ±15 degrees relative to horizontal. Element 12: wherein the mainbore leg has a length ($L_m$), and further wherein a twist of the mainbore leg and the lateral bore leg relative to the second bore and the third bore occurs within a first 50% of the length ($L_m$). Element 13: further including one or more spacers or one or more spot welds coupling the mainbore leg and the lateral bore leg for maintaining the twist. Element 14: wherein placing the multilateral junction proximate the intersection between the main wellbore and the lateral wellbore includes: running the multilateral junction downhole with the second plane in a first substantially vertical position; and rotating the multilateral junction when it approaches the intersection such that the second plane is in a second substantially horizontal position. Element 15: further including selectively accessing the main wellbore or the lateral wellbore through the multilateral junction with an intervention tool.

Those skilled in the art to which this application relates will appreciate that other and further additions, deletions, substitutions and modifications may be made to the described embodiments.

What is claimed is:

1. A multilateral junction, comprising:

a y-block, the y-block including;

a housing having a first end and a second opposing end;

a single first bore extending into the housing from the first end, the single first bore defining a first centerline; and second and third separate bores extending into the housing and branching off from the single first bore, the second bore defining a second centerline and the third bore defining a third centerline;

a mainbore leg having a first mainbore leg end coupled to the second bore and a second opposing mainbore leg end; and a lateral bore leg having a first lateral bore leg end coupled to the third bore and a second opposing lateral bore leg end, the mainbore leg and the lateral bore leg twisted with respect to the second bore and the third bore such that a first plane taken through centerlines of the second opposing mainbore leg end and the second opposing lateral bore leg end is angled by at least 15 degrees relative to a second plane taken through the second centerline and the third centerline.

2. The multilateral junction as recited in claim 1, wherein the first plane is angled by at least 45 degrees relative to the second plane.

3. The multilateral junction as recited in claim 1, wherein the first plane is angled from 80 degrees to 90 degrees relative to the second plane.

4. The multilateral junction as recited in claim 1, wherein the first plane is angled by 90 degrees relative to the second plane.

5. The multilateral junction as recited in claim 1, wherein the mainbore leg has a length ($L_m$), and further wherein a twist of the mainbore leg and the lateral bore leg relative to the second bore and the third bore occurs within a first 80% of the length ($L_m$).

6. The multilateral junction as recited in claim 5, wherein the twist of the mainbore leg and the lateral bore leg relative to the second bore and the third bore occurs within the first 50% of the length ($L_m$).

7. The multilateral junction as recited in claim 5, wherein the twist of the mainbore leg and the lateral bore leg relative to the second bore and the third bore occurs within the first 30% of the length ($L_m$).

8. The multilateral junction as recited in claim 1, further including one or more spacers coupling the mainbore leg to the lateral bore leg for maintaining the twist.

9. The multilateral junction as recited in claim 8, wherein the one or more spacers at least partially surround the mainbore leg and the lateral bore leg.

10. The multilateral junction as recited in claim 1, further including one or more spot welds coupling the mainbore leg and the lateral bore leg for maintaining the twist.

11. The multilateral junction as recited in claim 1, wherein when the second plane is positioned horizontally, the second opposing lateral bore leg end of the lateral bore leg is above the second opposing mainbore leg end of the mainbore leg.

12. The multilateral junction as recited in claim 11, wherein when the second plane is positioned horizontally, the second opposing lateral bore leg end of the lateral bore leg is directly above the second opposing mainbore leg end of the mainbore leg.

13. A well system, comprising:

a main wellbore;

a lateral wellbore extending from the main wellbore;

a multilateral junction positioned at an intersection of the main wellbore and the lateral wellbore, the multilateral junction including;

a y-block, the y-block including;

a housing having a first end and a second opposing end;

a single first bore extending into the housing from the first end, the single first bore defining a first centerline; and second and third separate bores extending into the housing and branching off from the single first bore, the second bore defining a second centerline and the third bore defining a third centerline;

a mainbore leg having a first mainbore leg end coupled to the second bore and a second opposing mainbore leg end in the main wellbore; and a lateral bore leg having a first lateral bore leg end coupled to the third bore and a second opposing lateral bore leg end in the lateral wellbore, the mainbore leg and the lateral bore leg twisted with respect to the second bore and the third bore such that a first plane taken through centerlines of the second opposing mainbore leg end and the second opposing lateral bore leg end is angled by at least 15 degrees relative to a second plane taken through the second centerline and the third centerline.

14. The well system as recited in claim 13, wherein the first plane is angled from 80 degrees to 90 degrees relative to the second plane.

15. The well system as recited in claim 14, wherein the second plane is less than ±15 degrees relative to horizontal.

16. The well system as recited in claim 13, wherein the mainbore leg has a length ($L_m$), and further wherein a twist of the mainbore leg and the lateral bore leg relative to the second bore and the third bore occurs within a first 50% of the length ($L_m$).

17. The well system as recited in claim 13, further including one or more spacers or one or more spot welds coupling the mainbore leg and the lateral bore leg for maintaining the twist.

18. A method for forming a well system, comprising:

placing a multilateral junction proximate an intersection between a main wellbore and a lateral wellbore, the multilateral junction including;

a y-block, the y-block including;

a housing having a first end and a second opposing end;

a single first bore extending into the housing from the first end, the single first bore defining a first centerline; and second and third separate bores extending into the housing and branching off from the single first bore, the second bore defining a second centerline and the third bore defining a third centerline;

a mainbore leg having a first mainbore leg end coupled to the second bore and a second opposing mainbore leg end in the main wellbore; and a lateral bore leg having a first lateral bore leg end coupled to the third bore and a second opposing lateral bore leg end in the lateral wellbore, the mainbore leg and the lateral bore leg twisted with respect to the second bore and the third bore such that a first plane taken through centerlines of the second opposing mainbore leg end and the second opposing lateral bore leg end is angled by at least 15 degrees relative to a second plane taken through the second centerline and the third centerline.

19. The method as recited in claim 18, wherein placing the multilateral junction proximate the intersection between the main wellbore and the lateral wellbore includes:

running the multilateral junction downhole with the second plane in a first substantially vertical position; and rotating the multilateral junction when it approaches the intersection such that the second plane is in a second substantially horizontal position.

20. The method as recited in claim 18, further including selectively accessing the main wellbore or the lateral wellbore through the multilateral junction with an intervention tool.

* * * * *